US008782977B2

(12) United States Patent
Burgess

(10) Patent No.: US 8,782,977 B2
(45) Date of Patent: Jul. 22, 2014

(54) INTERIOR WALL CAP FOR USE WITH AN EXTERIOR WALL OF A BUILDING STRUCTURE

(71) Applicant: Mull-It-Over Products, Grandville, MI (US)

(72) Inventor: Bruce Harold Burgess, Grand Haven, MI (US)

(73) Assignee: Mull-It-Over Products, Grandville, MI (US)

( * ) Notice: Subject to any disclaimer, the term of this patent is extended or adjusted under 35 U.S.C. 154(b) by 0 days.

(21) Appl. No.: 13/711,030

(22) Filed: Dec. 11, 2012

(65) Prior Publication Data

US 2013/0097948 A1 Apr. 25, 2013

Related U.S. Application Data

(63) Continuation-in-part of application No. 13/349,191, filed on Jan. 12, 2012, now Pat. No. 8,572,914.

(60) Provisional application No. 61/461,383, filed on Jan. 18, 2011, provisional application No. 61/510,634, filed on Jul. 22, 2011.

(51) Int. Cl.
*E04B 2/88* (2006.01)

(52) U.S. Cl.
USPC ..... 52/235

(58) Field of Classification Search
CPC ..... E04B 2/74; E04B 2/7409; E04B 2/88; E04B 2/885; E04B 1/82; E04B 1/98; E04B 2/96; E04B 2/965; E04B 2/967
USPC ..... 252/606; 52/235, 287.1, 393, 394, 395, 52/272, 273, 275, 279, 281
See application file for complete search history.

(56) References Cited

U.S. PATENT DOCUMENTS

| | | | | |
|---|---|---|---|---|
| 3,922,830 | A * | 12/1975 | Guarino et al. | 52/794.1 |
| 4,648,228 | A | 3/1987 | Kiselewski | |
| 4,798,035 | A * | 1/1989 | Mitchell et al. | 52/281 |
| 6,267,347 | B1 | 7/2001 | Ryan et al. | |
| 6,351,915 | B1 * | 3/2002 | Puckett | 52/167.1 |
| 8,572,914 | B2 * | 11/2013 | Burgess | 52/235 |
| 2005/0072084 | A1 * | 4/2005 | Anderson, III | 52/455 |
| 2012/0180414 | A1 * | 7/2012 | Burgess | 52/300 |
| 2013/0097948 | A1 * | 4/2013 | Burgess | 52/232 |

FOREIGN PATENT DOCUMENTS

| | | | |
|---|---|---|---|
| JP | 06044829 | U | 6/1994 |
| JP | 2010013847 | A | 1/2010 |
| KR | 1020090039281 | A | 4/2009 |

OTHER PUBLICATIONS

Locbae Kim—Korean Intellectual Property Office, International Search Report, 2 pages, Jun. 25, 2012, Republic of Korea.

* cited by examiner

*Primary Examiner* — Andrew J Triggs
(74) *Attorney, Agent, or Firm* — McGarry Bair PC

(57) ABSTRACT

A wall cap for an interior wall of a building structure, the building structure comprising at least one exterior wall and at least one interior wall and a gap formed between the at least one interior wall and the at least one exterior wall. The wall cap comprises at least one material for abating an undesirable physical property of the gap.

38 Claims, 19 Drawing Sheets

INTERIOR WALL CAP FOR USE WITH AN EXTERIOR WALL OF A BUILDING STRUCTURE

CROSS-REFERENCE TO RELATED APPLICATIONS

This application is a continuation-in-part of U.S. patent application Ser. No. 13/349,191, filed Jan. 12, 2012, now U.S. Pat. No. 8,572,914, issued Nov. 5, 2013, which claims the benefit of U.S. Provisional Patent Application No. 61/461,383, filed Jan. 18, 2011, and U.S. Provisional Patent Application No. 61/510,634, filed Jul. 22, 2011, all of which are incorporated herein by reference in their entirety.

BACKGROUND

Buildings having an exterior façade primarily composed of glass typically comprise a non-loading bearing curtain wall which supports the glass. The curtain wall typically comprises an aluminum frame for supporting the glass comprising a series of mullions for anchoring the frame to the building structure and may also provide a place to abut vertical and/or horizontal building partitions (e.g. walls, floors/ceilings). The mullions provide a space between the building partitions and the glass which may result in undesirable sound transmission between partitioned spaces within the building. The mullion material may also contribute to the transmission of undesirable sound.

Conventional methods for minimizing sound transmission include adding mass to the mullion or adding sound absorbing materials to the mullion, such as filling the mullion with insulation. Another method involves attaching a vibration isolation cover to the mullion face. In another example, a partition wall is cantilevered out to meet the glass and the partition wall is sealed with the glass using caulk.

These methods for minimizing sound transmission often require modifications for each building structure and typically do not provide the desired magnitude decrease in sound transmission. Methods such as cantilevering the partition wall out to meet the glass do not allow for differential movement between the building and the curtain wall system, which can result in tearing of the sealing caulk.

The space provided between the building partitions and the glass can also result in undesirable transmission of fire between partitioned spaces within the building. Wall to ceiling and wall to floor joints can be provided with fire-rated materials to provide a fire stop or break to safeguard against the spread of fire within adjacent spaces of a building. However, the systems used to provide fire-rated materials to wall to ceiling and wall to floor joints often do not work with a curtain wall structure and thus the intersection between the building partition and the glass can present a challenge in terms of preventing the spread of fire between adjacent spaces when a curtain wall is in use.

BRIEF SUMMARY

According to one embodiment, the invention comprises a wall cap for an interior partition wall of a building structure, the building structure comprising at least one room having a first side defined at least partially by at least one exterior wall and a second side defined at least partially by at least one interior partition wall, and a gap formed between the at least one interior partition wall and the at least one exterior wall, the wall cap comprising at least one elongated member having a first end configured for attachment to the at least one interior partition wall and a second distal end in juxtaposition with the at least one exterior wall and being spaced from the at least one exterior wall, and having an outer surface extending substantially across the gap, an underside of the elongated member defining a chamber with at least a portion of the interior partition wall. At least one material is disposed within the chamber having at least one characteristic which abates at least one undesirable physical property of the gap. When the at least one elongated member is mounted in cantilever fashion to a portion of the interior partition wall, such that the elongated member is allowed to move relative to the exterior wall, and substantially fills the gap between the interior partition wall and the corresponding exterior wall, the at least one material abates the at least one undesirable physical property of the gap.

According to another embodiment, the at least one material comprises at least one width of fire-rated material configured to abate the transmission of at least one of flame, heat or hot gases across the gap. The at least one width of fire-rated material has a fire rating of at least 1 hour. The fire-rated material can include a material that increases in volume when exposed to temperatures of about 300° F. and above.

According to yet another embodiment, the at least one material comprises at least one width of sound-damping material configured to abate at least one of transmission or amplification of vibration across the gap. The sound-damping material can comprise at least one of an open cell foam, a melamine-based foam, mass loaded vinyl, intumescent foam or combinations thereof.

According to another embodiment, the at least one material is adhesively secured to the underside of the elongated member, and the elongated member is mounted to the at least one interior wall by at least one fastener.

According to yet another embodiment, the at least one material comprises at least one first width of fire-rated material configured to abate the transmission of at least one of flame, heat or hot gases across the gap and at least one second width of sound-damping material configured to abate at least one of transmission or amplification of vibration across the gap. The at least one first width of fire-rated material can further comprise a backing plate having an offset flange mounted to the at least one interior partition wall. The backing plate can comprise continuous web of material extending generally along a longitudinal length of the elongated member and receiving the first width of fire-rated material. The backing plate can also comprise a plurality of brackets which retain the first width of fire-rated material to the at least one interior partition wall. The second width of sound-damping material can be mounted to the underside of the elongated member. When the elongated member is mounted to the at least one interior partition wall, the elongated member covers the at least one first width of fire-rated material, whereby the wall cap then provides both fire and vibration abating characteristics to the gap.

According to yet another embodiment, the second distal end of the elongated member comprises a distal outer surface in juxtaposition with the at least one exterior wall, and being spaced a distance from the at least one exterior wall, and further comprising at least one gasket disposed within the spaced distance between the distal outer surface of the elongated member and the at least one exterior wall, whereby the at least one gasket provides a seal between the elongated member at the at least one exterior wall.

According to another embodiment, the at least one characteristic of the at least one material abates a fire transmission property of the gap.

According to another embodiment, the at least on characteristic of the at least one material abates at least one of a vibration transmission or vibration amplification property of the gap.

According to another embodiment, a wall cap for an interior partition wall of a building structure, the building structure comprising at least one exterior wall having at least a portion formed from glass and at least one interior partition wall, and a gap formed between an end of the at least one interior partition wall and the glass portion of the exterior wall, comprises at least one elongated member having a first end configured for attachment to the at least one interior partition wall and a second distal end in juxtaposition with the glass portion of the exterior wall and being spaced a distance from the glass portion of the exterior wall, and having an outer surface extending substantially across the gap, an underside of the elongated member defining a chamber with at least a portion of the interior partition wall and wherein the at least one elongated member is mounted in cantilever fashion to a portion of the interior partition wall, such that the elongated member is allowed to move relative to the glass portion of the exterior wall, and substantially fills the gap between the end of the interior partition wall and the corresponding glass portion of the exterior wall.

According to another embodiment, a wall cap for an interior partition wall of a building structure, the building structure comprising at least one room defined by at least one exterior wall separating the room from an exterior of the building structure and at least one interior partition wall, and a gap formed between the at least one interior partition wall and the at least one exterior wall, the wall cap comprising at least one elongated member having a first end configured for attachment to the at least one interior partition wall and a second distal end in juxtaposition with the at least one exterior wall and being spaced from the at least one exterior wall, and having an outer surface extending substantially across the gap, an underside of the elongated member defining a chamber with at least a portion of the interior partition wall and at least one material disposed within the chamber having at least one characteristic which abates at least one undesirable physical property of the gap, wherein, when the at least one elongated member is mounted in cantilever fashion to a portion of the interior partition wall, such that the elongated member is allowed to move relative to the exterior wall, and substantially fills the gap between the interior partition wall and the corresponding exterior wall, the at least one material abates the at least one undesirable physical property of the gap.

DETAILED DESCRIPTION

Figure 1:
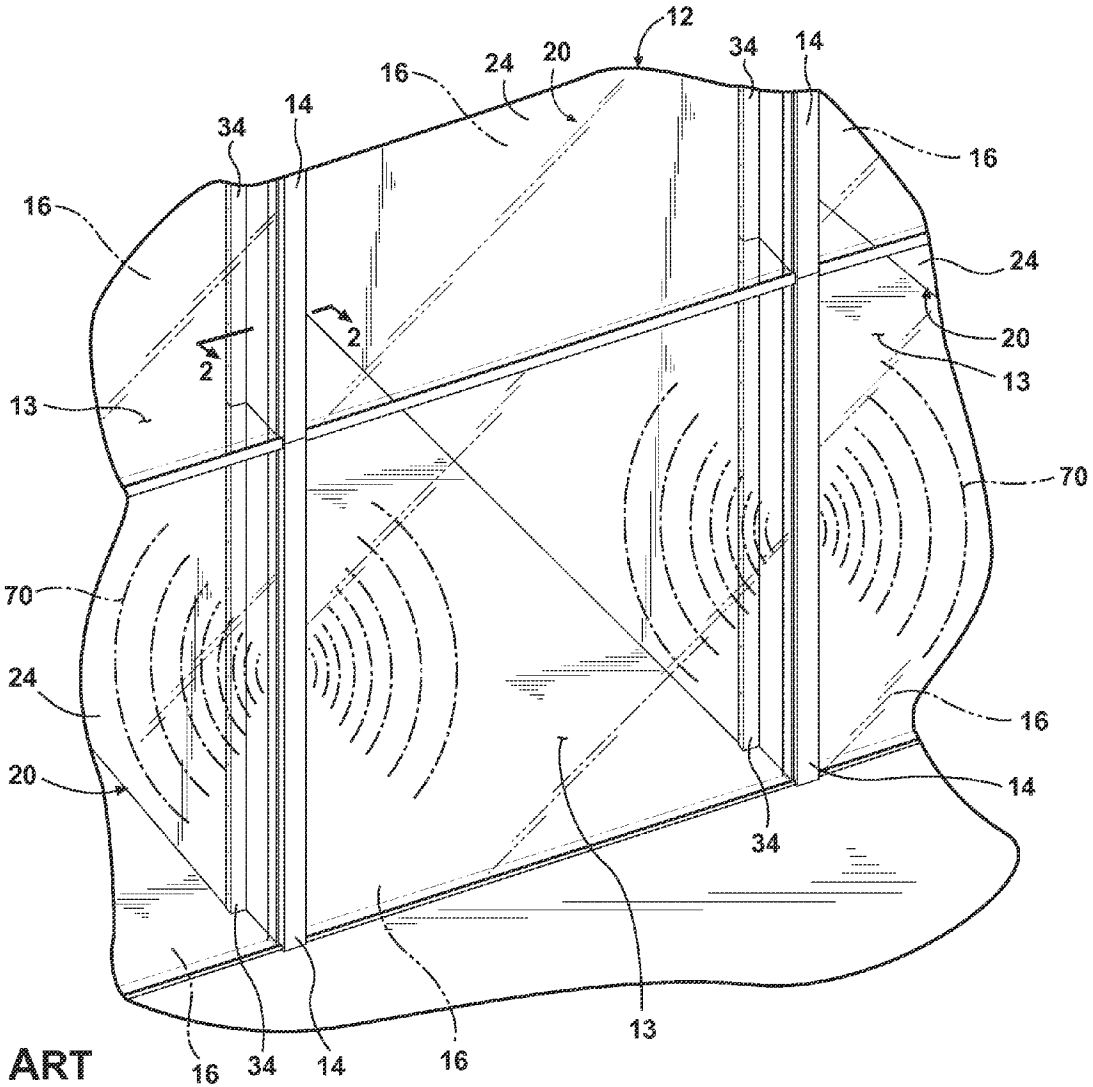
Fig. 1 PRIOR ART
FIG. 1 is a perspective view of a portion of a building having a curtain wall, as is known in the prior art.

FIG. 1 illustrates a portion of a building structure 12 having a plurality of partitions 20 forming multiple areas or rooms 13 within the building structure 12 and having a curtain wall 10, as is known in the art. The curtain wall 10 shares many features of a traditional curtain wall, which will not be described in detail except as necessary for a complete understanding of the invention. As illustrated in FIG. 1, the curtain wall 10 forms an exterior or outer wall of the building structure 12. Curtain walls are typically non-structural walls that do not carry any load weight of the building, other than its own load weight, but rather form a façade of the building structure. A curtain wall is typically used to provide a building with an exterior wall formed of glass, for example. While the curtain wall 10 is illustrated as an exterior façade of the building structure 12, ribbon windows and window walls might also be used for the façade of the building structure. A window wall can also be used as an interior partition wall for an area inside the building structure 12.

Figure 2:
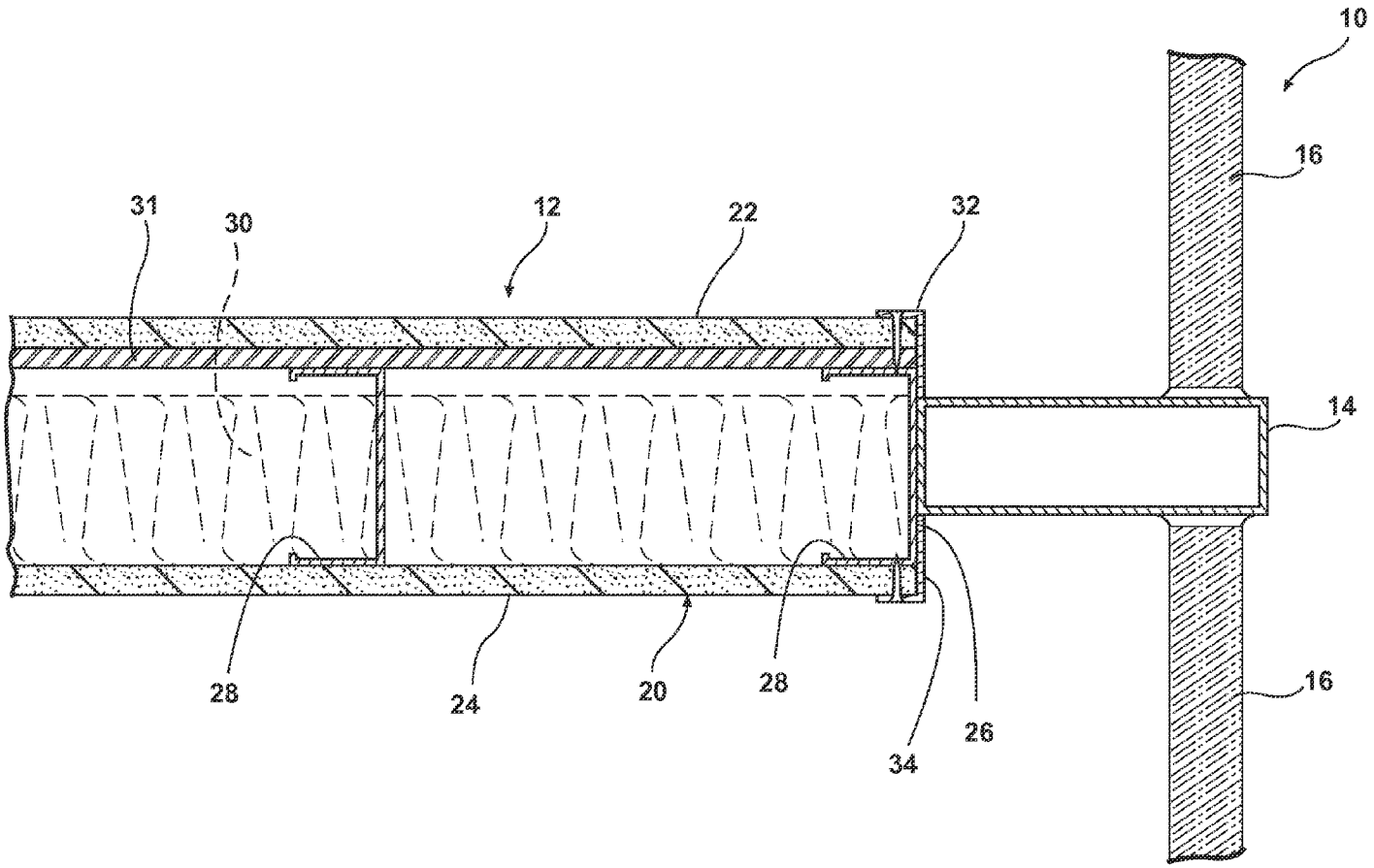
Fig. 2 PRIOR ART
FIG. 2 is a partial cross-sectional view of the building structure and curtain wall of the prior art of FIG. 1 taken along the line 2-2.

FIG. 2 is a cross-sectional view of a portion of the curtain wall 10 anchored to the building structure 12 that can be used with the embodiments of the invention described herein. The curtain wall 10 comprises mullion 14 which supports in-fills 16 that can be made of glass, metal or thin stone, for example. The mullion 14 can be made from any suitable metal or metal alloy material, but is typically made of Aluminum. The mullion 14 can abut a vertical partition, such as partition 20, and/or horizontal partition, such as a floor, of the building structure 12 as is known in the art. The exact manner by which the mullion 14 is anchored to the building structure 12 is not germane to the invention. A plurality of mullions 14 can be used to anchor a plurality of in-fills 16 to the building structure 12, as is known in the art.

The partition 20 can be a vertical partition (as shown in FIG. 1), such as an interior wall or an exterior wall, or a horizontal partition (not shown), such as a floor or ceiling, for example. The partition 20 can include a first side 22, a second side 24 and an end 26 hung on a framing system comprising at least one stud 28. The stud 28 can be made of wood, metal or metal alloy, and is typically made of steel. The partition 20 can be made of drywall, gypsum wallboard, sheet rock or plasterboard, for example, and can have any suitable length depending on the architecture of the building. The partition 20 can be filled with any suitable type of insulation 30, such as fiberglass insulation, as is known in the art. The partition 20 can optionally also include resilient channel strips 31, that are commonly installed with drywall to offset the drywall from the framing system.

Optional first and second trim pieces 32, 34 can be mounted on the partition 20 adjacent the mullion 14 for aesthetic reasons and can be made of the same material and have the same finish as the mullion 14. In one example, the first and second trim pieces 32, 34 can be made of light gauge aluminum.

Figure 3:
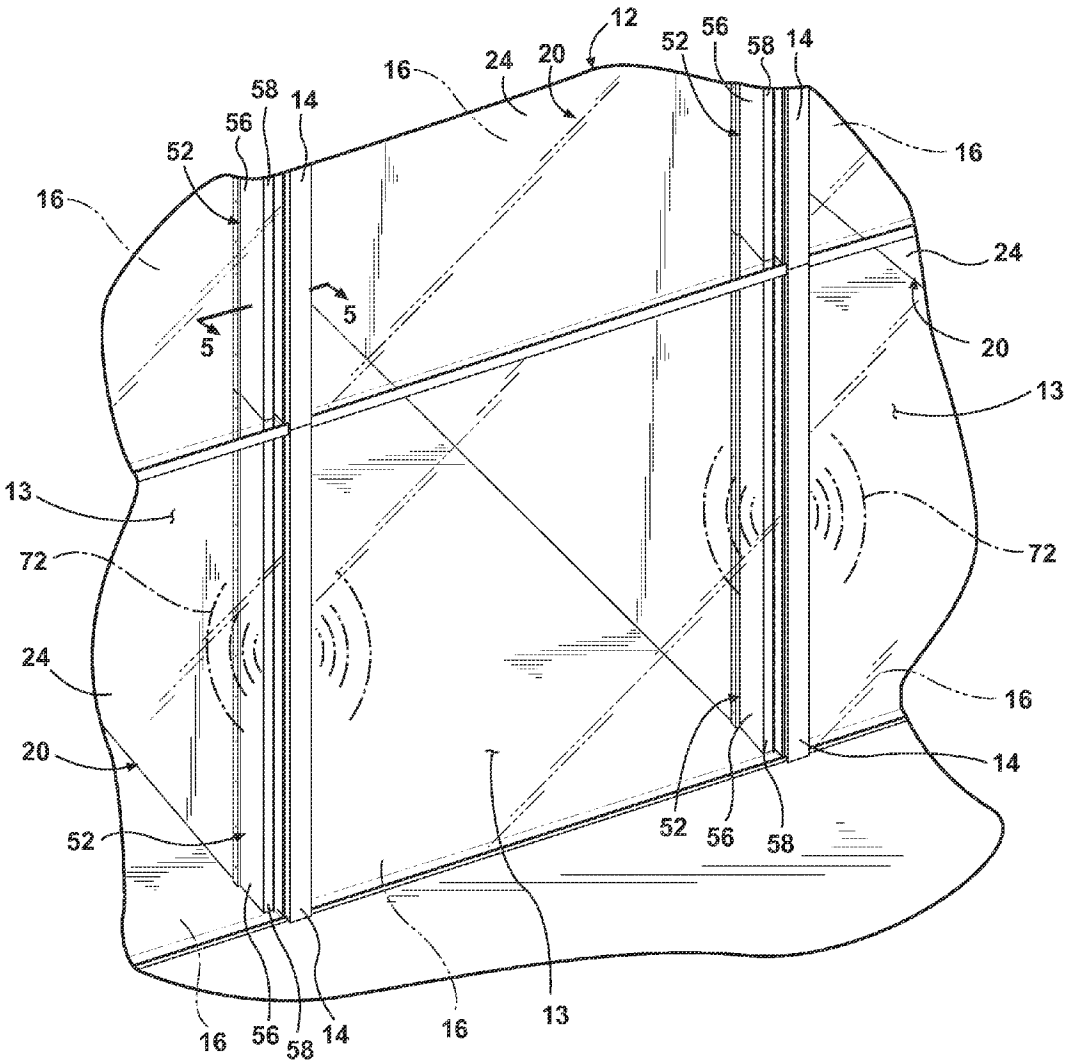
FIG. 3 is a perspective view of a portion of the building of FIG. 1 having a plurality of wall caps according to an embodiment of the invention
Figure 4:
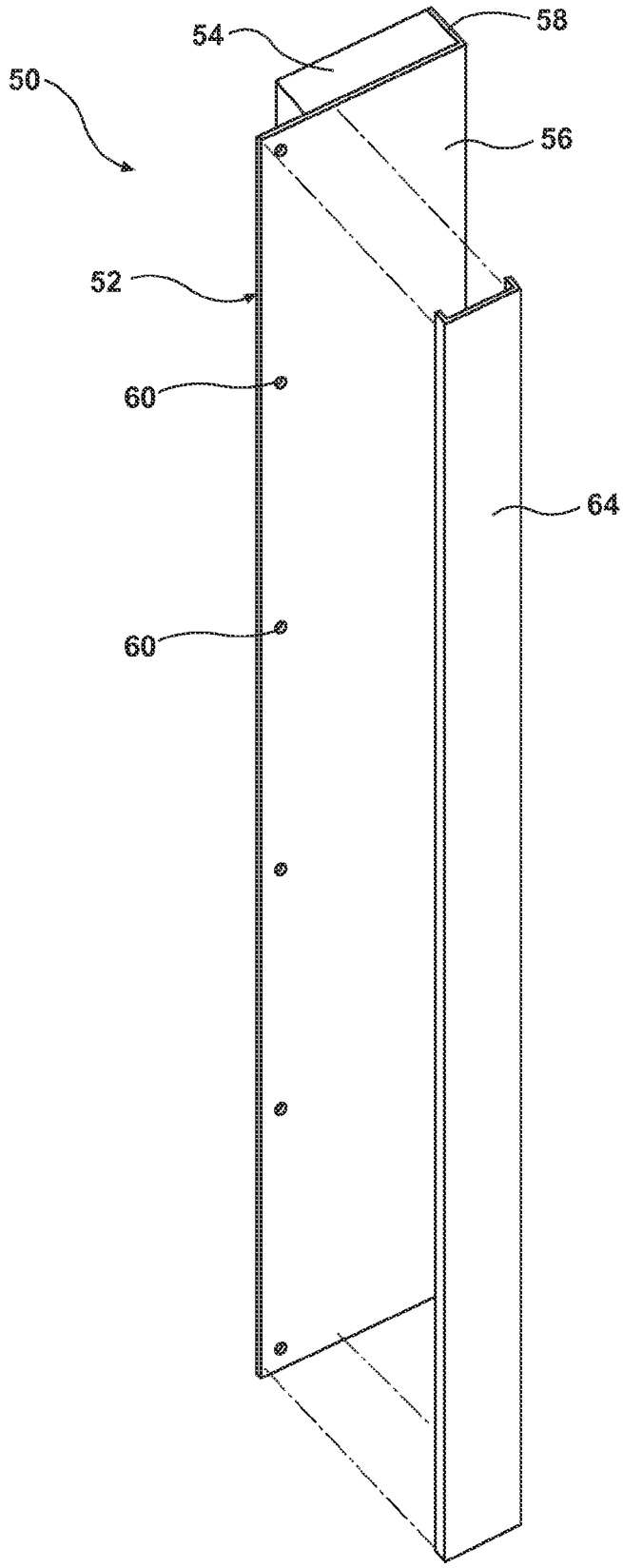
FIG. 4 is a perspective view of the wall cap of FIG. 3 according to an embodiment of the invention.

FIGS. 3 and 4 illustrate a wall cap 50, which can also be referred to as a mullion cap when used in combination with a mullion, according to an exemplary embodiment of the invention. The wall cap 50 can be used to abate a physical property of a gap defined by an exterior wall (e.g. the in-fill 16) and an interior wall (e.g. the partition 20). Non-limiting examples of a physical property of the gap include a vibration transmission property, a vibration amplification property and a fire transmission property. Fire transmission property can include the ability to transfer or allow the passage of heat, flame and/or hot gases. Vibration transmission and amplification can include the ability to transfer sound and/or amplify sound waves. As used herein, the term abate refers to lessening, reducing or removing a property.

The wall cap or mullion cap 50 can comprise an end cap 52 and a sound insulating material 54 installed with the building structure 12 of FIGS. 1 and 2. The mullion cap 50 includes a first leg 56 and a second leg 58 extending from a first end of the first leg 56. The first leg 56 can include one or more apertures 60 for securing the mullion cap 50 to a structure. The end cap 52 can be made of any suitable metal, polymeric, composite, metal alloy or wood material and have any suitable color or finish to provide the desired aesthetic appearance. For example, the end cap 52 can be an aluminum extrusion that is anodized or painted to match the finish of the curtain wall 10 and mullion 14. The first leg 56, the second leg 58 and the adjacent portion of the partition 20 can define a sound-receiving chamber which is provided with sound insulating material 54 to dampen sound and vibration emanating from the building structure 12 before being transmitted to the partition 20.

The mullion cap 50 can have any suitable length depending on the parameters of the structure in which the mullion cap 50 is being installed. For example, the length of the mullion cap 50 can be based on the height of the partition 20. The length of the first leg 56 and second leg 58 can vary depending on the distance between the partition 20 and the curtain wall 10 and the width of the partition 20, for example. It is also within the scope of the invention for the mullion cap 50 to not include the second leg 58.

The sound insulating material 54 can be any suitable material or layers of material for absorbing and deadening sound to provide a desired Sound Transmission Class (STC) rating. The STC is a single-number rating of a material's or an assembly's ability to resist airborne sound transfer at frequencies of 125-4000 Hz. In general, a higher STC rating blocks more noise from transmitting through a partition.

One example of a sound insulating material 54 is a multilayer acoustical composite barrier, such as Prospec® Composite available from Pinta Acoustic Inc., which comprises a Hypalon® coated willtec open-cell foam layer having a convoluted surface bonded to a mass loaded vinyl layer with a willtec decoupler layer. Additional non-limiting examples include batt or blanket insulation, melamine-based foam, intumescent foam, acoustic foam, mineral board, mass loaded vinyl, damping compounds and combinations of different materials.

The sound insulating material 54 can be mounted to the end cap 52 using any suitable mechanical or non-mechanical fasteners, non-limiting examples of which include screws, clips, snaps, clamps, adhesive and welds.

The mullion cap 50 can also include an optional trim piece 64 which can be separate from the end cap 52 (FIG. 4) or integrally formed with the end cap 52 (not shown). When the trim piece 64 is not integrally formed with the end cap 52, the trim piece 64 can be secured to the mullion cap 50 and/or partition 20 any suitable mechanical or non-mechanical fasteners, such as screws or an adhesive, for example, or the trim piece 64 can be configured as a snap-on piece.

Figure 5:
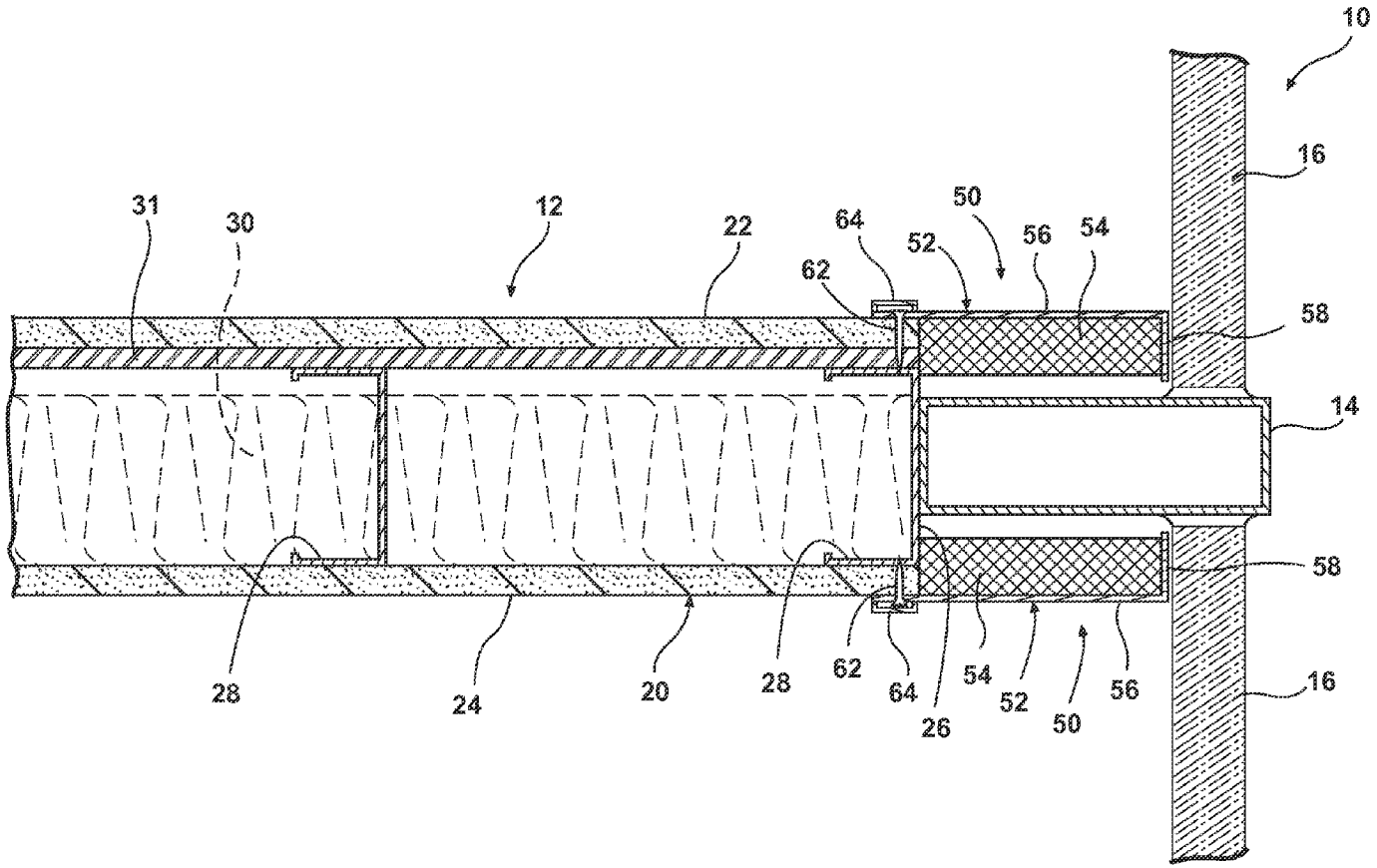
FIG. 5 is a partial cross-sectional view of the wall cap of FIG. 2 taken along the line 5-5 according to an embodiment of the invention.

Referring now to FIG. 5, the first leg 56 of the end cap 52 can be secured to the partition 20 by fasteners 62 inserted through the apertures 60. The fasteners 62 can be any suitable type of mechanical fastener, such as a bolt or screw, for example. The fastener 62 can extend through the partition wall 20 and optionally into the stud 28 such that the mullion cap 50 can be secured to both the partition 20 and any underlying support structure of the partition 20. The optional trim piece 64 can be secured over the fasteners 62 in the first leg 56 as part of the mullion cap 50. The trim cap 64 can have the same color and/or finish as the end cap 52.

While the mullion cap 50 is illustrated as being secured to the partition 20 using the fasteners 62, it is within the scope of the invention for the mullion cap 50 to be secured to the partition 20 using any suitable mechanical or non-mechanical fastener, non-limiting examples of which include screws, nails, adhesives, and/or double-sided tape.

The mullion cap 50 at least partially spans the distance from the partition 20 to the in-fill 16 and extends into a gap 53 defined by the in-fill 16, the mullion 14 and the partition end 26. The mullion cap 50 and sound insulating material 54 can extend adjacent to, but spaced from the mullion 14. In one example, the distance between the sound insulating material 54 of the mullion cap 50 and the mullion 14 is approximately ⅛ of an inch, although this distance can vary depending on the building structure and in some instances can range from 1/16 of an inch to 6½ inches. It is also within the scope of the invention for an outer surface of the sound insulating material 54 to be adjacent to and in contact with the mullion 14 along at least a portion of the mullion 14. It is also within the scope of the invention that the distance between the sound insulating material 54 of the installed mullion cap 50 and the mullion 14 is small enough such that movement and/or settling of the curtain wall 10 and/or building structure 12 results in contact between the mullion 14 and the sound insulating material 54 that may or may not be temporary.

As illustrated in FIG. 5, the mullion cap 50 does not span the entire distance from the partition 20 to the in-fill 16, but is spaced from the in-fill 16 to allow for differential movement between the curtain wall 10 and the building structure 12. For example, the second leg 58 of the end cap 52 can be spaced approximately 1/16 to 1/4 of an inch from the in-fill 16. It is also within the scope of the invention that the distance between the sound second leg 58 of the end cap 52 and the in-fill 16 is small enough such that movement and/or settling of the curtain wall 10 and/or building structure 12 results in contact between the second leg 58 and the in-fill 16 that may or may not be temporary. The mullion cap 50 is anchored to the partition 20 such that the mullion cap cantilevers off of the partition 20. Even though movement and/or settling of the curtain wall 10 and/or building structure 12 may result in contact of the mullion cap 50 with the in-fill 16 over time, the mullion cap 50 is not supported by or anchored to the in-fill 16.

Figure 6A:
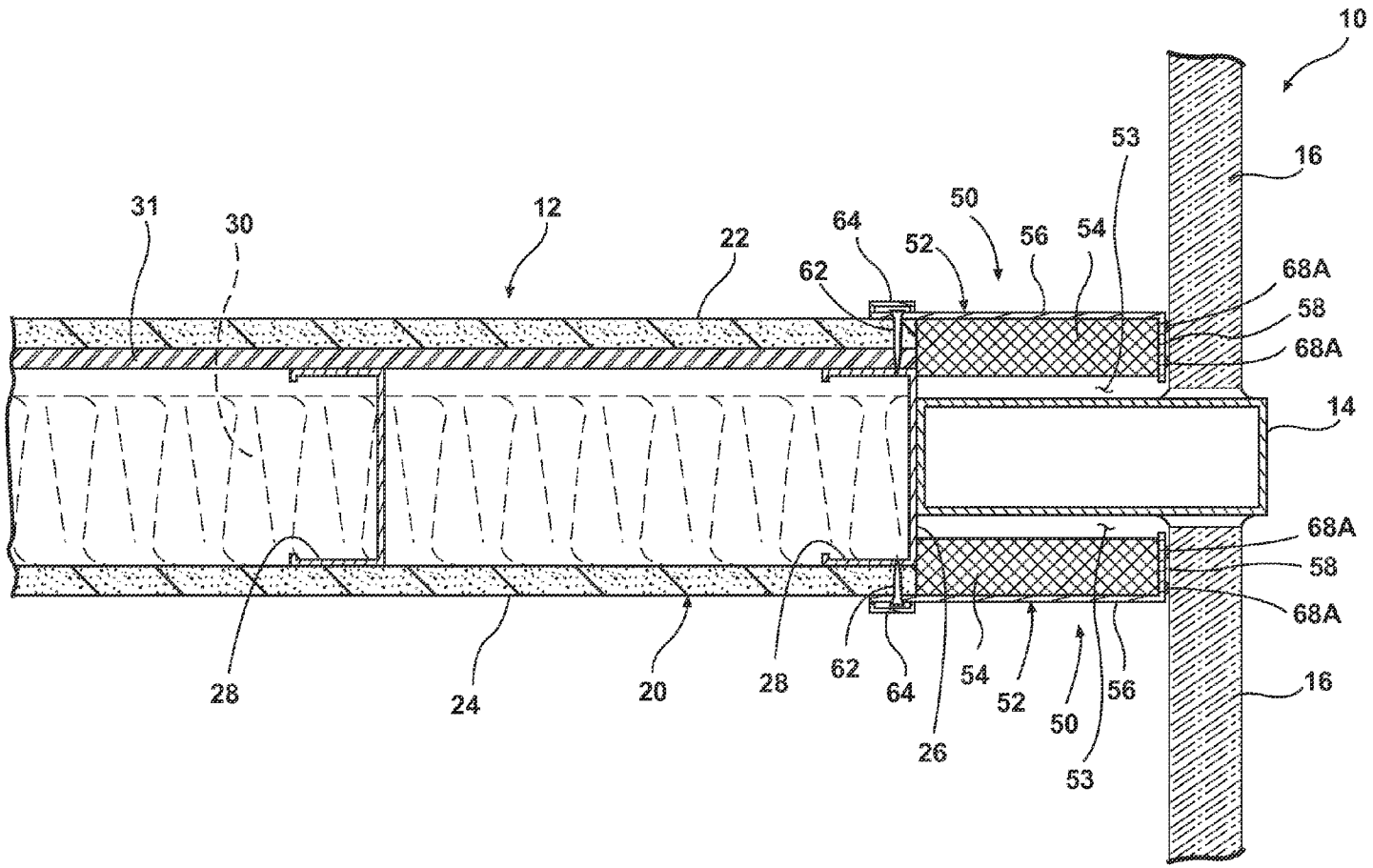
FIG. 6A is a partial cross-sectional view of the wall cap of FIG. 5 installed with a plurality of gaskets according to an embodiment of the invention.
Figure 6B:
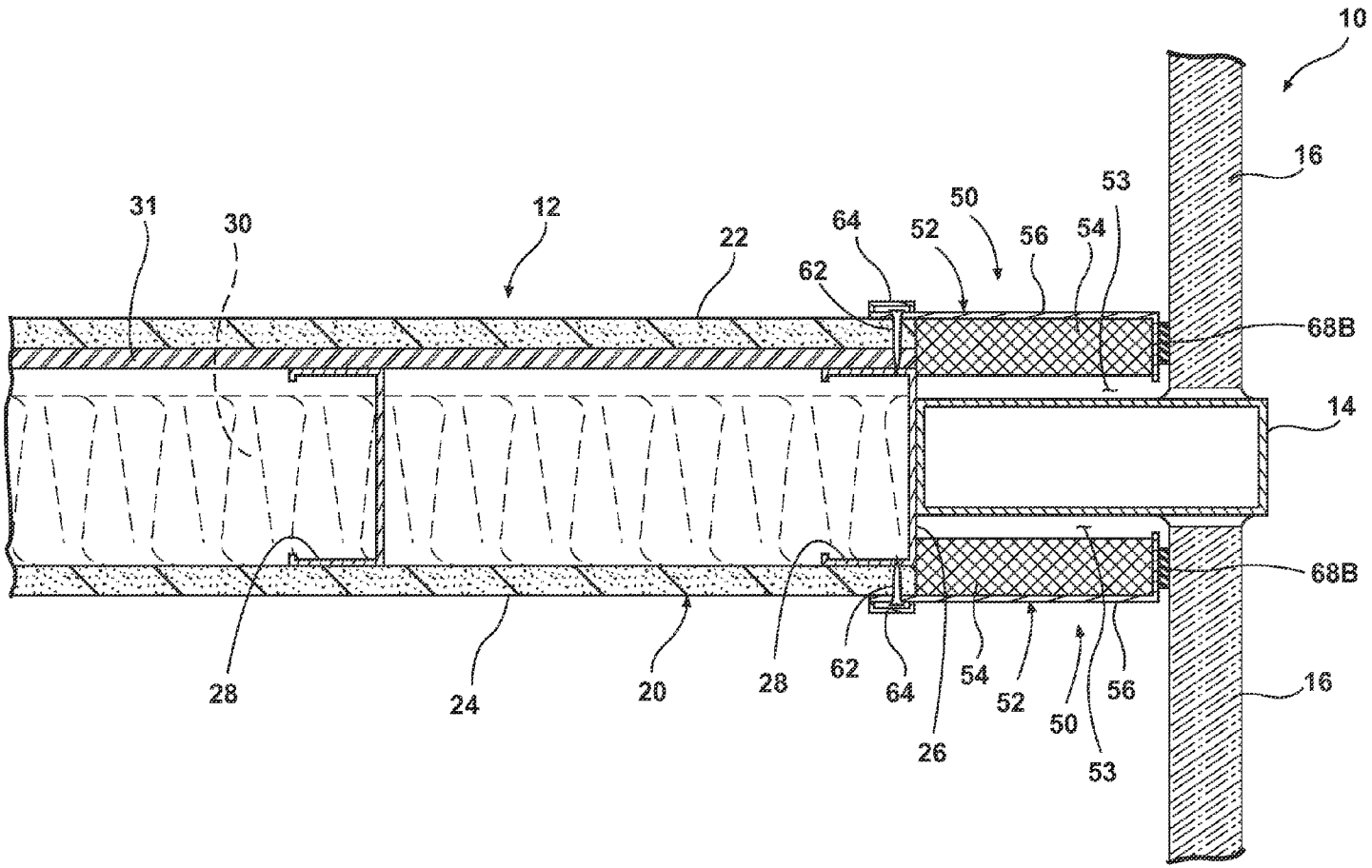
FIG. 6B is a partial cross-sectional view of the wall cap of FIG. 5 installed with a plurality of gaskets according to an embodiment of the invention.

Referring now to FIGS. 6A and 6B, it is also within the scope of the invention for one or more gaskets or compressible seals 68*a* or 68*b*, such as a neoprene gasket, closed cell foam or other compressible gasket material, to be provided between the second leg 58 of the end cap 52 and the in-fill 16. Multiple gaskets 68*a* can be used, as illustrated in FIG. 6A, or a single, continuous gasket 68*b* can be provided, as illustrated in FIG. 6B.

Figure 7:
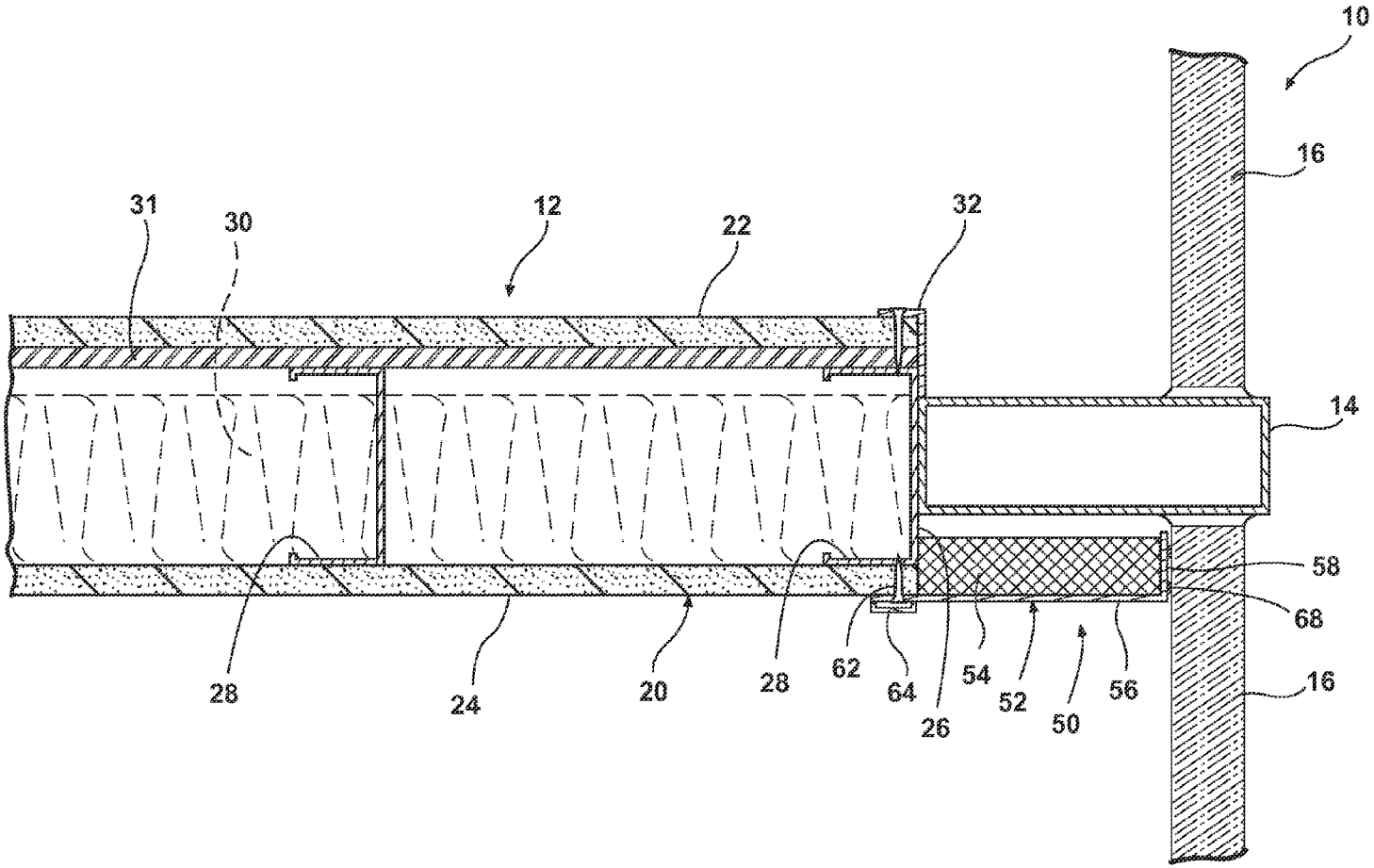
FIG. 7 is a is a partial cross-sectional view of the wall cap of FIG. 6 installed on one side of the mullion of FIG. 2 according to an embodiment of the invention.

While FIGS. 5 and 6A and B illustrate the use of the mullion cap 50 on both sides of the partition 20, it is also within the scope of the invention for the mullion cap 50 to only be used on a single side of the partition 20, as illustrated in FIG. 7, with gaskets (FIG. 7) or without gaskets 68 (not shown).

Optionally, acoustical sealant, such as OSI Acoustic/Sound Sealant, can be used at various joints within the system such as between the end cap 52 and the partition 20, between the mullion 14 and the partition 20 and between the mullion 14 and the in-fill 16.

While the mullion cap 50 is illustrated as comprising an end cap 52 having a first leg 56 and a second leg 58, it is also within the scope of the invention for the end cap 52 to only comprise the first leg 56. For example, when used without the gasket 68, the second leg 58 may not be needed. When the gasket 68 is used with the mullion cap 50, such as is shown in FIG. 6, the second leg 58 can provide a surface to which the gasket 68 can be secured.

While the mullion cap 50 is described with respect to the curtain wall 10, the mullion cap 50 can be used with any curtain wall or comparable building structure, such as a ribbon wall, strip windows, storefront, or other glass support systems, for example.

Acoustical testing for a partition/curtain wall/mullion interface assembly with and without a mullion cap was determined in accordance with the following American Society for Testing and Materials (ASTM) standards: ASTM E 90-09, *Standard Test Method for Laboratory Measurement of Airborne Sound Transmission Loss of Building Partitions*; ASTM E 413-10, *Classification for Rating Sound Insulation*; ASTM E 1332-10a, *Standard Classification for Rating Outdoor-Indoor Sound Attenuation*; ASTM E 2235-04, *Standard Test Method for Determination of Decay Rates for Use in Sound Insulation Test Methods*.

Test Set-Up Descriptions

The test equipment used to conduct the tests meet the requirements of ASTM E 90. The microphones were calibrated before conducting sound transmission loss tests.

Sound transmission loss tests were initially performed on a filler wall that was designed to test 48 inch by 72 inch and 72 inch by 48 inch specimens. The filler wall is described in more detail below in the description of Sample A. The filler wall achieved an STC rating of 69. A 48 inch by 72 inch plug was removed from the filler wall assembly and the sample was placed on an isolation pad in the test opening formed by the removal of the plug. Duct seal was used to seal the perimeter of the sample to the test opening on both sides. The interior side of the sample, when installed, was approximately 1/4 inch from being flush with the receiving room side of the filler wall.

Figure 8:
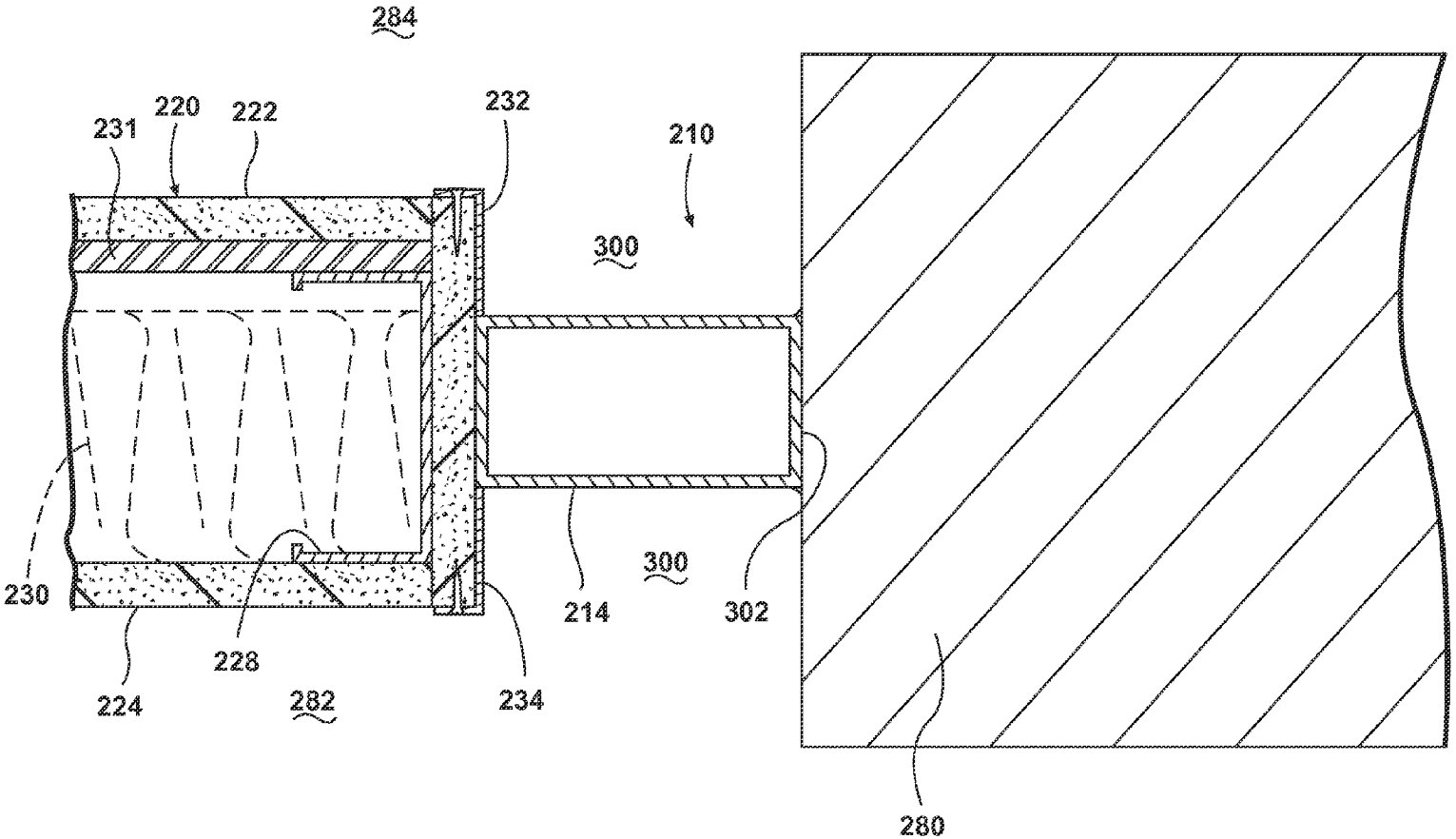
FIG. 8 is a partial cross-sectional view of a sound chamber test set-up.

Sample A:

The test set-up for sample A is illustrated schematically in FIG. 8. FIG. 8 illustrates a partition/curtain wall/mullion interface assembly test set-up comprising a portion of a test curtain wall 210 and a test partition 220 similar to the curtain wall 10 and partition 20 of FIGS. 1 and 2 described above, except that the test curtain wall 210 comprises a test mullion 214 coupled with a sound chamber wall 280 for determining the STC rating of the system instead of in-fills of glass or metal. Therefore, elements of the test curtain wall 210 and test partition 220 similar to those of the curtain wall 10 and partition 20 are labeled with the prefix 200.

The test partition 220 (filler wall) comprises a portion of a demising wall or interior wall consisting of a single 6 inch, 20 gauge steel stud wall with studs 228 spaced on 24 inch centers. One layer of 5/8 inch gypsum board 224 was fastened to the vertical studs 228 on a receive side 282. On a source side 284, 25 gauge resilient channels 231 were hung horizontally on the studs 228 (24 inch centers). One layer of 5/8 inch gypsum board 222 was fastened to the resilient channels 286 on 24 inch centers. The cavity of the test partition 220 was insulated with 5 inch thick, 4 pounds per $ft^3$ Thermafiber mineral wool insulation 230.

A section of test mullion 214 was installed in a 5 5/16 inch wide by 72 inch high gap 300 between the test partition 220 and a sound chamber wall test opening 302. The test mullion 214 was a box extrusion type made of aluminum, 5 5/16 inch by 72 inches by 2 1/2 inch, having an extrusion wall thickness of 0.092 inches and weighing 1.74 pounds per lineal foot. The test mullion 214 was sealed to the test opening 302 on both sides using an acoustic sealant. The test mullion 214 was not sealed to the test partition 220. Light gauge aluminum trim 232, 234 was used to cap the area between the face of the test partition 220 and the test mullion 214 on both sides. The light gauge trim 232, 234 was an "L" channel type made of Aluminum, 2 15/16 inch by 72 inches by 1 1/8 inch, having a material thickness of 0.053 inch and weighing 0.22 pounds per lineal foot.

Figure 9:
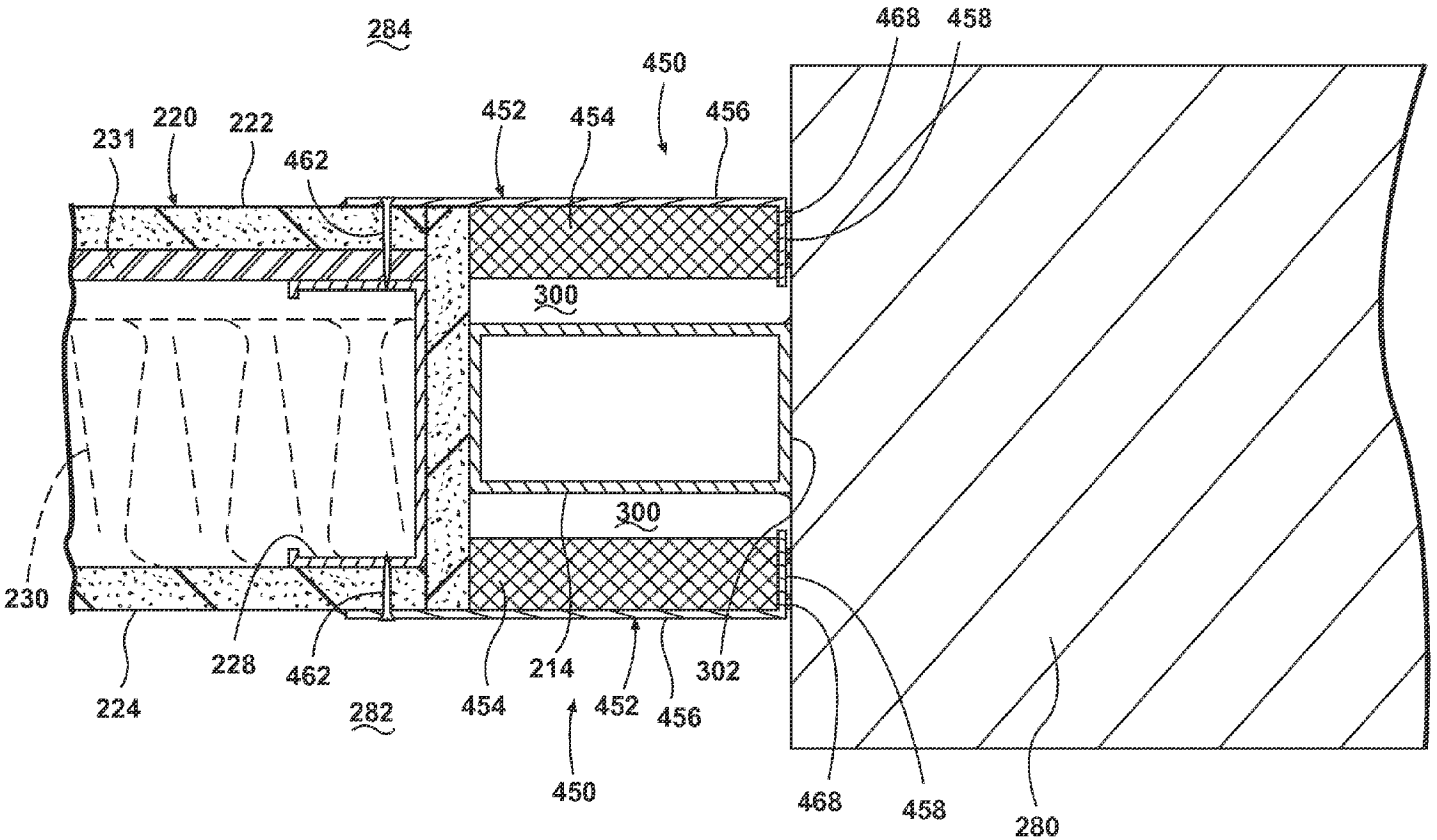
FIG. 9 is a partial cross-sectional view of a wall cap in use with the sound chamber test set-up of FIG. 8.

Sample B:

The test set-up for sample B was similar to sample A except that the aluminum trim 232, 234 was removed, and is illustrated schematically in FIG. 9. An exemplary mullion cap 450 was installed on both sides of the test partition 220, extending across the gap 300 adjacent the test mullion 214. The exemplary mullion cap 450 is similar to the mullion cap 50 of FIGS. 3-7, therefore elements of the exemplary mullion cap 450 similar to the mullion cap 50 of FIGS. 3-7 are labeled with the prefix 400. The mullion caps 450 were fastened to the test partition 220 with drywall screws 462 and sealed using acoustical sealant. The mullion caps 450 were sealed to the vertical section of the test opening 302 with 1/8 inch thick (1/16 inch compressed) neoprene gaskets 468 and sealed to the test opening 302 at the top and bottom with acoustical sealant. The mullion cap 450 comprises an end cap 452 made of 0.130 inch thick aluminum and insulating material 454 comprising a 0.340 inch thick closed cell foam layer, a 0.085 inch thick mass loaded vinyl layer and a 0.670 inch thick closed cell foam layer. The mullion cap 450 had a weight of 1.84 pounds per lineal foot and measured 6 13/16 inch by 72 inches by 1 1/2 inch. There was a 7/8 inch (nominal) air gap between an interior face of the closed cell foam and the test mullion 214.

Sample C:

The test set-up for sample C was similar to sample B except that the mullion cap 450 on the source side 284 of the test partition 220 was removed.

Sample D:

The test set-up for sample D was similar to sample B except that the neoprene gaskets 468 between the mullion caps 450 and the test opening 302 were removed, providing a 1/16 inch gap between the test opening 302 and the mullion caps 450.

Sample E:

The test set-up for sample E was similar to sample B except that there was a 3/16" inch gap between the test opening 302 and the mullion caps 450 and 1/4" thick (3/16" compressed) neoprene gaskets 468 were used.

Sample F:

The test set-up for sample F was similar to sample B except that there was a 5/16" inch gap between the test opening 302 and the mullion caps 450 and 3/8" thick (5/16" compressed) neoprene gaskets 468 were used.

Sample G:

The test set-up for sample G was similar to sample B except that there was a 5/16" inch gap between the test opening 302 and the mullion caps 450 and the neoprene gaskets 468 were replaced with 1/2" thick (5/16" compressed) closed cell foam gaskets.

Table 1 below lists the STC and OITC results for Samples A-G. The STC rating was calculated in accordance with ASTM E 413. The OITC (Outdoor-Indoor Transmission Class) rating was calculated in accordance with ASTM E 1332.

TABLE 1

STC and OITC Ratings for Mullion with and without Mullion Caps

| Sample | Description | STC | OITC |
|---|---|---|---|
| A | Without mullion caps | 28 | 28 |
| B | Mullion caps on both sides with 1/8" neoprene gasket | 54 | 41 |
| C | Mullion cap on one side with gasket | 51 | 41 |
| D | Mullion cap on both sides without gasket | 54 | 40 |
| E | Mullion caps on both sides with 1/4" neoprene gasket | 57 | 35 |
| F | Mullion caps on both sides with 3/8" neoprene gasket | 57 | 36 |
| G | Mullion caps on both sides with 1/2" closed cell foam gasket | 57 | 35 |

As can be seen from the test results in Table 1, the use of the mullion cap 450 increases the STC rating of the test assembly from 28 to 57, meaning sound transmission is decreased when a mullion cap is installed. Even the use of a single mullion cap on one side of the mullion (sample C) decreases the sound transmission through the test partition/curtain wall/mullion interface assembly. As can be seen by comparing the results for samples B and E-G, the size of the gap between the wall cap and the exterior wall and the thickness and type of gasket used can be varied to provide a desired sound rating and differential movement between the curtain wall and interior partition walls.

Referring back to FIG. 1, sound waves, illustrated schematically as waves 70, are transmitted between rooms 13 through the mullions 14 and in-fills 16 of the curtain wall 10. As illustrated by the test results, a typical demising wall, such as the filler wall used in the test set-up, can be provided with sufficient structure and insulation to have an STC rating of 69. An STC rating greater than 60 is generally considered to correspond to enough sound proofing to render most sounds from an adjacent room inaudible. However, as illustrated by test sample A, a curtain wall system comprising a mullion can have an STC rating as low as 28. This is significantly less than the STC rating of the adjacent wall and generally low enough such that loud speech on the opposite side of the wall can be heard and possibly understood. Therefore, most of the sound transmitted between rooms 13 in the building structure 12 is through the mullions 14 at the intersection between the exterior wall and the interior wall, not the partitions 20. In this manner, building structures utilizing curtain wall systems often have much lower overall STC ratings than similar building structures that do not utilize curtain wall systems. The transmission of sound between rooms in a building can be annoying and distracting to occupants and can also raise privacy issues.

As illustrated in FIG. 3 and supported by the test data above, the use of a wall cap as described herein in a building structure having a curtain wall system can dramatically decrease the transmission of sound waves, illustrated as waves 72. The use of the mullion cap 450 in the test set-ups B-G significantly increased the STC rating of the system from 28 to greater than 50. STC ratings above 50 are generally considered to correspond to loud sounds such as musical instruments or a stereo as being faintly audible, but not enough to bother the majority of the population. The use of the mullion cap described herein allows for the use of a curtain wall system without the sacrifice in sound attenuation normally ascribed to curtain wall systems.

Figure 10:
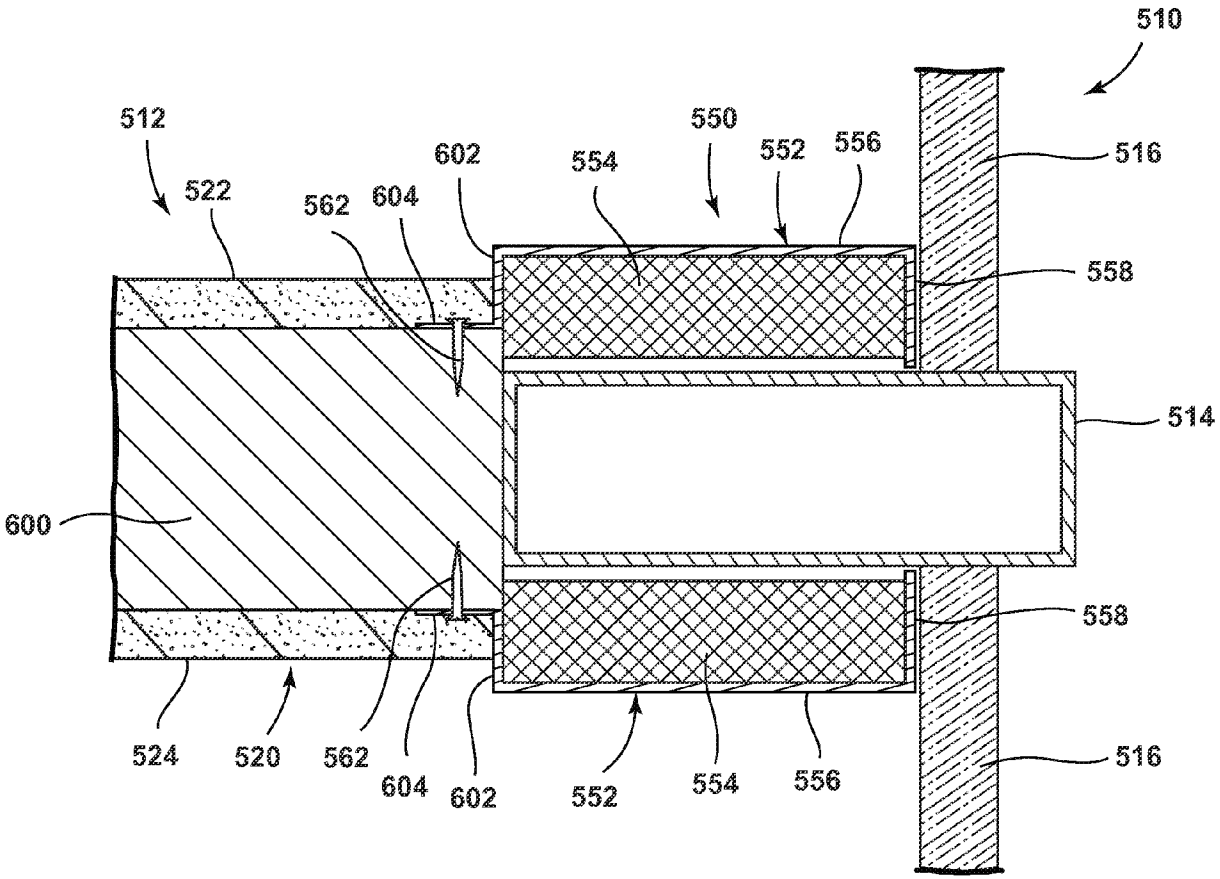
FIG. 10 is a partial cross-sectional view of a building structure and wall cap according to an embodiment of the invention.

FIG. 10 illustrates a wall cap 550 which is similar to the wall cap 50 except for the profile of the wall cap 550. The wall cap 550 can be used with a building structure 512 which is similar to the building structure 12 except for the partition 520. Therefore, elements of the wall cap 550 and building structure 512 similar to those of the wall cap 50 and building structure 12 will be numbered with the prefix 500.

Still referring to FIG. 10, the building structure 512 includes a partition 520 which comprises an acoustic rated wall construction 600 and first and second drywall sides 522 and 524 installed on an outside face of the acoustic rated wall construction 600. The wall cap 550 includes first leg 556 and a second leg 558 extending from the first end of the first leg 556. The second leg 558 is positioned adjacent the in-fills 516 when installed with the building structure 512. The wall cap 550 further includes a third leg 602 at a second end of the first leg 556, opposite the second leg 558. A fourth leg 604 extends from an end of the third leg 602 opposite the end connected with the first leg 556, and is generally parallel to, but offset from, the first leg 556. The offset profile allows for the wall cap 550 to be used when the partition 520 is offset from the center of the mullion 514, the width of the partition 520 is not sufficient to accommodate the dimension of the second leg 558, or the width of the mullion 514 is too large to accommodate the dimension of the second leg 558.

The wall caps 550 are secured to the acoustic rated wall construction 600 through the fourth leg 604 using one or more fasteners 562 and cantilever out over the mullion 514. The first and second drywall sides 522 and 524 are installed such that the drywall sides 522, 524 cover the fourth leg 604, with a distal end of the drywall sides 522, 524 generally abutting the third leg 602 of the wall caps 550. As illustrated in FIG. 10, the length of the third leg 602 is such that the first leg 556 of the wall caps 550 are not flush with the drywall sides 522, 524. Alternatively, the length of the third leg 602 can be configured such that the first leg 556 is generally flush with the drywall sides 522, 524.

Figure 11:
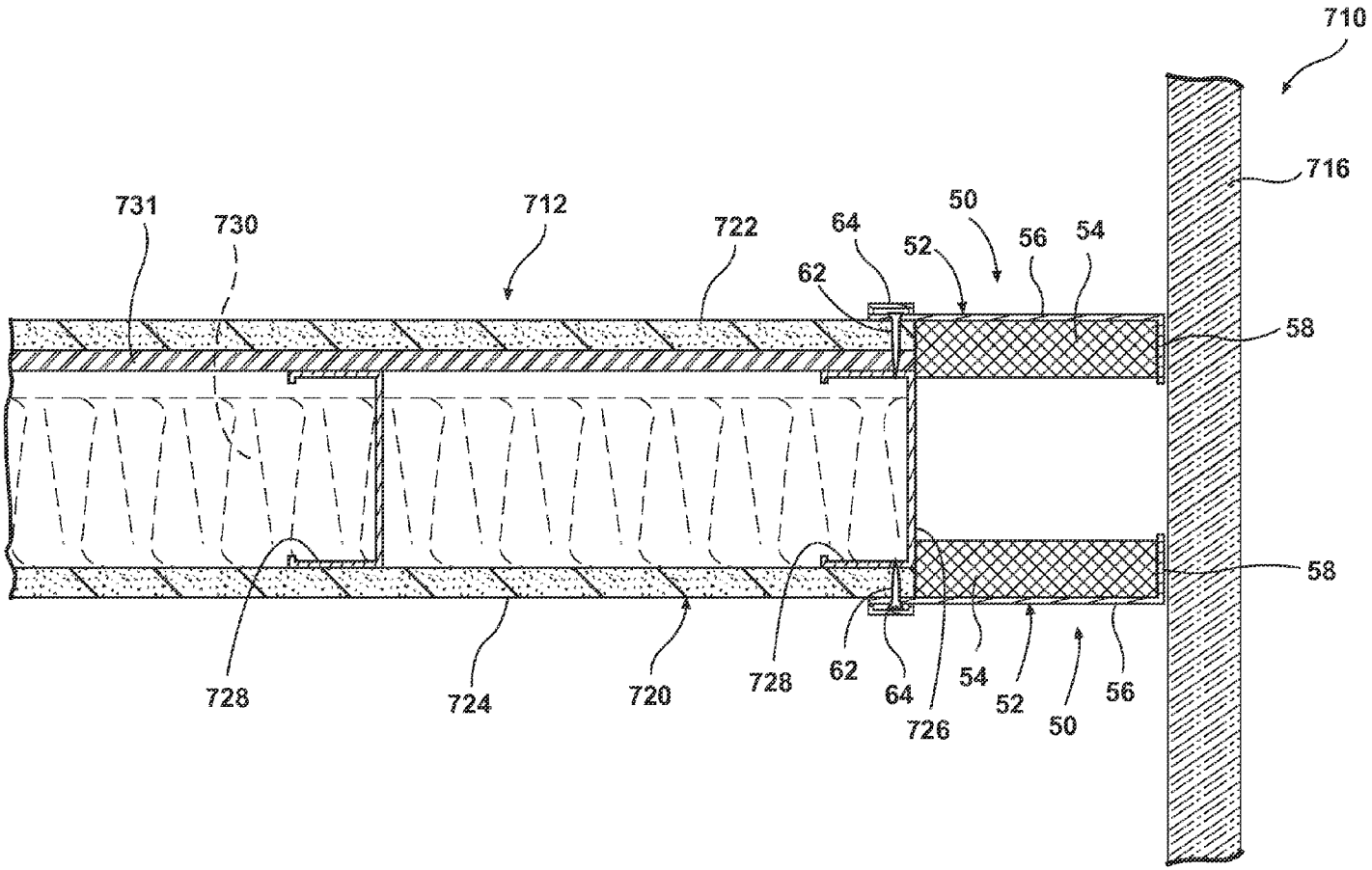
FIG. 11 is a partial cross-sectional view of a building structure and wall cap according to an embodiment of the invention.

FIG. 11 illustrates another embodiment of the invention in which the wall cap 50 is used with a building structure 712 and curtain wall 710. Therefore, elements of the building structure 712 and curtain wall 710 similar to those of the building structure 12 and curtain wall 10 will be labeled with the prefix 700.

The wall cap 50 can be secured to the building structure 712 in the same manner as described above with respect to the building structure 12. The wall cap 50 can be installed such that the wall cap 50 cantilevers off of the partition 720 and spans the gap between the end 726 of the partition 720 and the infill 716. The wall cap 50 can be configured such that the second leg 58 is positioned adjacent to the infill 716.

As illustrated in FIG. 11, the wall cap 50 can be used to span the distance between a partition and the adjacent infill even when no mullion is present. The wall cap 50 can be used with a curtain wall, which is secured to the outside edge of a building frame, interior partitions, and storefront and window wall structures that are formed within the perimeter of the building frame, with or without a mullion in a manner similar to that described above with respect to FIG. 11.

Figure 12:
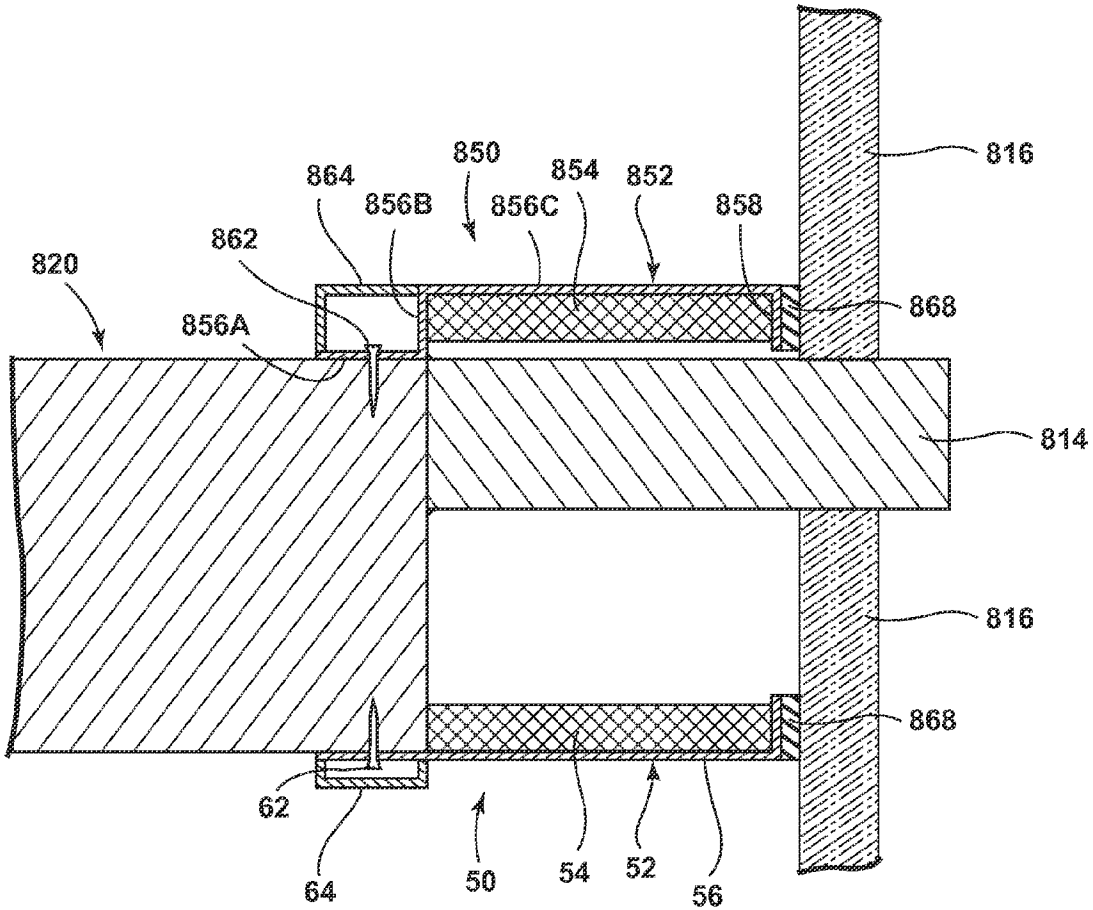
FIG. 12 is a partial cross-sectional view of a building structure and a wall cap according to an embodiment of the invention.

FIG. 12 illustrates another embodiment of the invention comprising the wall cap 50 on one side of the partition and a wall cap 850, which is similar to the wall cap 50 except for the shape of the end cap 852 on the other side of the partition opposite the wall cap 50. Therefore, elements in the wall cap 850 similar to those of the wall cap 50 are numbered with the prefix 800. The end cap 852 includes a first leg 856A, a second leg 856B extending from a distal end of the first leg 856A and generally orthogonal to the first leg 856A, and a third leg 856C extending from a distal end of the second leg 856B and generally parallel to and offset from the first leg 856A. A fourth leg 858 extends from a distal end of the third leg 856C opposite the second leg 856B. The first leg 856A can include one or more apertures (not shown) for securing the wall cap 850 to the partition 820 by fasteners 862 inserted through the apertures in a manner similar to that described above with respect to the wall cap 50 of FIG. 5 above.

The sound insulating material 854 can be mounted to the end cap 852 between the second leg 856B and the fourth leg 858 and adjacent the third leg 856C in a manner similar to that describe above for the sound insulating material 54 with respect to FIGS. 3-5. An optional separate or integral trim piece 864 can also be provided to conceal the fasteners 862 and provide a desired aesthetic appearance. The wall cap 850 can also include a gasket 868 between the in-fill 816 and the fourth leg 858, similar to that described above for the wall cap 50.

As illustrated in FIG. 12, the wall cap 850 can be used with building structures in which the mullion 814 is flush or nearly flush with one or both sides of the partition 820. The wall cap 850 can be used in combination with the wall cap 50, as illustrated in FIG. 12, when the mullion 814 is offset from one side of the partition 820. The wall cap 850 can also be used on both sides of the partition, depending on the dimensions and configuration of the structure. The dimensions of the first, second, third and fourth legs 856A-C and 858, respectively, of the wall cap 850 can be selected based on the dimensions of the relevant portions of the building structure, such as the offset of the mullion from the partition and the distance between the interior and exterior elements of the building structure.

Figure 13:
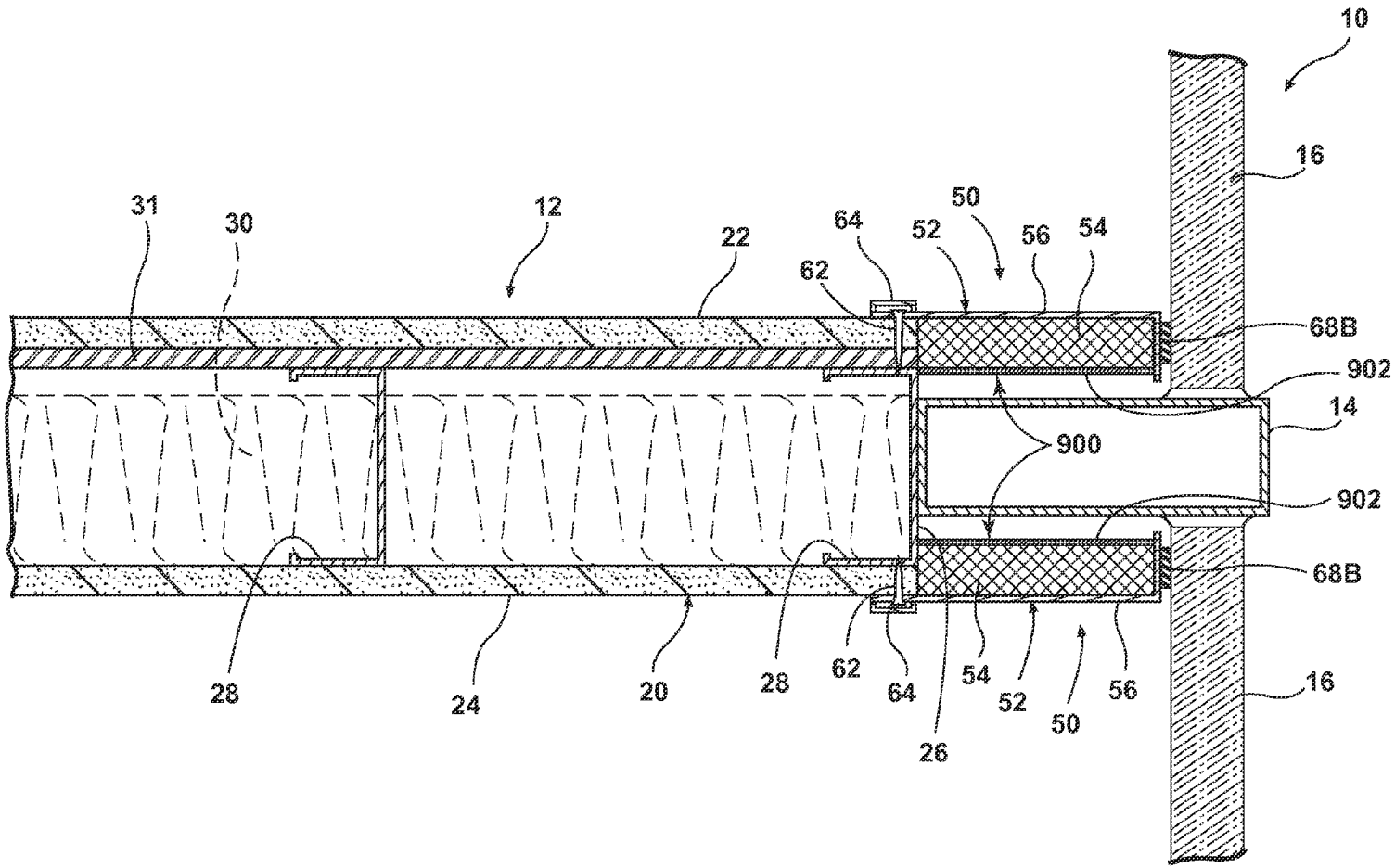
FIG. 13 is a partial cross-sectional view of a building structure and a wall and a wall cap having a fire rated assembly according to an embodiment of the invention.

FIG. 13 illustrates another embodiment of the invention in which the wall cap 50 includes a fire rated assembly 900 to provide the wall cap 50 with a fire rating. While the fire rated assembly 900 is described in the context of the wall cap 50, it will be understood that the fire rated assembly 900 can be used with any of the wall caps described herein.

The intersection where two-fire rated assemblies meet, for example a wall assembly and a floor/ceiling assembly, creates a joint through which flame and hot gasses from fire can spread. To prevent fire from spreading at this joint, fire rated construction joint assemblies are typically installed at these intersections. Many building codes also require that the gap at a curtain wall interface be treated to maintain the same fire integrity and protection as the adjacent floor and ceiling.

Various organizations on the national and international level have different jurisdiction and influence on building codes and can use different terminology and standards related to fire integrity and protection, some of which may change over time, thus some background information may be useful. For example, in the United States of America, the National Fire Protection Association (NFPA®) defines a fire rating as a classification indicating in time (hours) the ability of a structure or component to withstand a standardized fire test. This classification does not necessarily reflect performance of the rated components in an actual fire, but rather is related to the performance in a pre-approved standardized test. A thermal barrier is defined as a material that limits the average temperature rise of an unexposed surface to not more than 250° F. (139° C.) for a specified fire exposure complying with the standard time-temperature curve of NFPA 251, Standard Methods of Tests of Fire Resistance of Building Construction and Materials, or ASTM E 119, Standard Test Methods for Fire Tests of Building Construction and Materials, based on the standards as of the filing date of this application.

The International Code Council (ICC) defines a fire protection rating as the period of time that an opening protective assembly will maintain the ability to confine a fire as determined by tests prescribed in Section 715 and is stated in hours or minutes. Fire-resistance rating is the period of time a building element, component or assembly maintains the ability to confine a fire, continues to perform a given structural function, or both, as determined by the tests, or the methods based on tests prescribed in Section 703. An f-rating is the time period that the through penetration firestop system limits the spread of fire through the penetration when tested in accordance with ASTM E 814 (ASTM International). A t-rating is the time period that the penetration firestop system, including the penetrating item, limits the maximum temperature rise to 325° F. (163° C.) above its initial temperature through the penetration on the nonfire side when tested in according with ASTM E 814.

Thus, while the testing parameters and specifications can vary, in general, the fire integrity and protection properties of a material or structure are typically quantified based on the time a material or structure can withstand, confine and/or stop fire or limit an increase in temperature of a material or structure during exposure to fire.

The fire rated assembly 900 can include any material or combination of materials to provide the wall cap 50 with fire integrity and protection properties to effect the fire transmission properties at the intersection between the exterior partition and the interior partition. Non-limiting examples of suitable materials include firestopping insulation, such as a thermal ceramic insulation or fire batt insulation, fire rated mortar, fire rated caulk, fire rated gypsum material, vermiculite or perlite plaster products, and/or fire rated expanding foams or sealants, for example, that provide the desired fire rating.

Still referring to FIG. 13, the fire rated assembly 900 can include a fire rated material 902 adjacent the sound insulation material 54, such as a fire rated expanding material, for example. One example of a suitable fire rated expanding material is a fire rated foam, such as a polyurethane or silicone based foam, that is provided with an intumescent material. An intumescent material is a material that swells or expands and increases in volume when exposed to heat. Non-limiting examples of intumescent materials include graphite and sodium silicate based materials. At a predetermined temperature the intumescent material begins to expand on the fire side of the joint. For example, intumescent materials used in fire integrity and protection typically begin to expand around 300° F. or above, although materials that begin to expand at lower temperatures can also be used. The expanded intumescent material can abate the transmission of fire by absorbing heat and/or physically preventing the passage of fire (e.g. by filling or sealing the opening). Non-limiting examples of fire rated expanding material include SpecSeal® Series intumescent inserts (Specified Technologies, Inc., U.S.A.), Pyroplex® Fire Rated Expanding Foam (Pyroplex Ltd., United Kingdom), Sealmaster FireFoam (Sealmaster, England) and 3M™ FireDam™ Intumescent Coating, Fire Barrier Sealant and Fire Barrier Pillows (3M™, U.S.A.).

The fire rated material 902 can be adhered to the sound insulation material 54 continuously or discontinuously along the length of the sound insulating material 54 using any suitable mechanical or non-mechanical fastener, such as an adhesive, weld, pins or clamps. Alternatively, the fire rated material 902 can be formed as an integral layer of the sound insulating material 54.

Figure 14A:
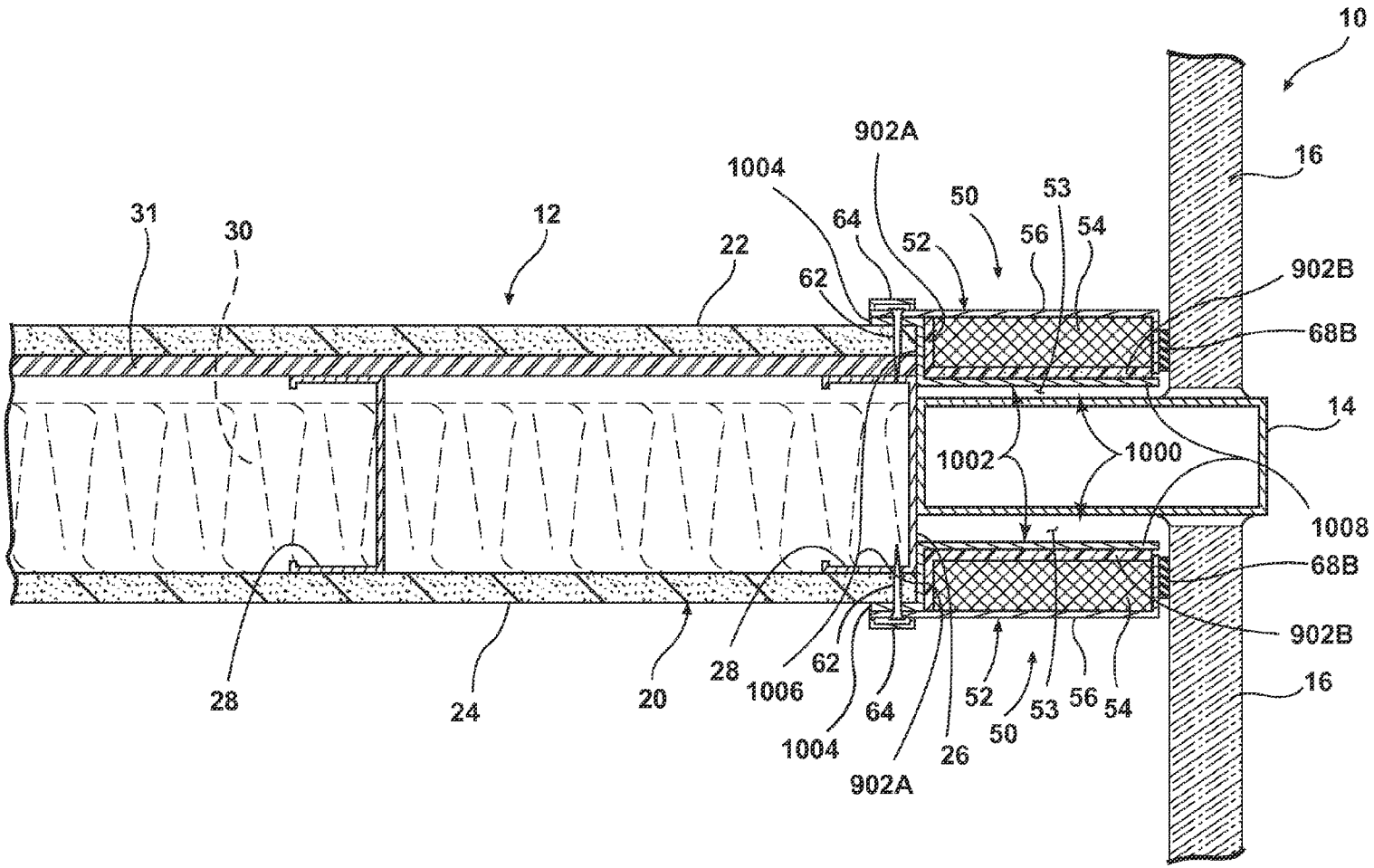
FIGS. 14A and 14B are partial cross-sectional views of a building structure and a wall cap having a fire rated assembly according to an embodiment of the invention.

FIGS. 14A and B illustrate a fire rated assembly 1000 that is similar to the fire rated assembly 900 except that the fire rated material 902 is mounted to a backing plate 1002 which is secured to the partition 20 for supporting the fire rated material 902 adjacent the mullion 14 in the gap 53. The backing plate 1002 can be in the form of a bent metal plate having a first leg 1004 which can be secured to the partition 20 using any suitable fastener, a second leg 1006 extending from a distal end of the first leg 1004 and a third leg 1008 extending from a distal end of the a second leg 1006, opposite the first leg 1004.

The length of the third leg 1008 can be selected so as to extend adjacent the mullion 14 toward the in-fill 16 such that a gap is provided between a distal end of the third leg 1008 and the in-fill 16 to allow for deflection of the curtain wall 10 and differential movement of the building structure. The backing plate 1002 can be secured to the partition 20 in a manner similar to that described for the wall cap 50 such that the backing plate 1002 cantilevers off of the partition 20. When the backing plate 1002 is used in combination with the wall cap 50, the trim piece 64 can be used to conceal both the wall cap fasteners 64, as described above, and the backing plate fasteners, which may be the same or different than the wall cap fasteners 64.

Figure 14B:
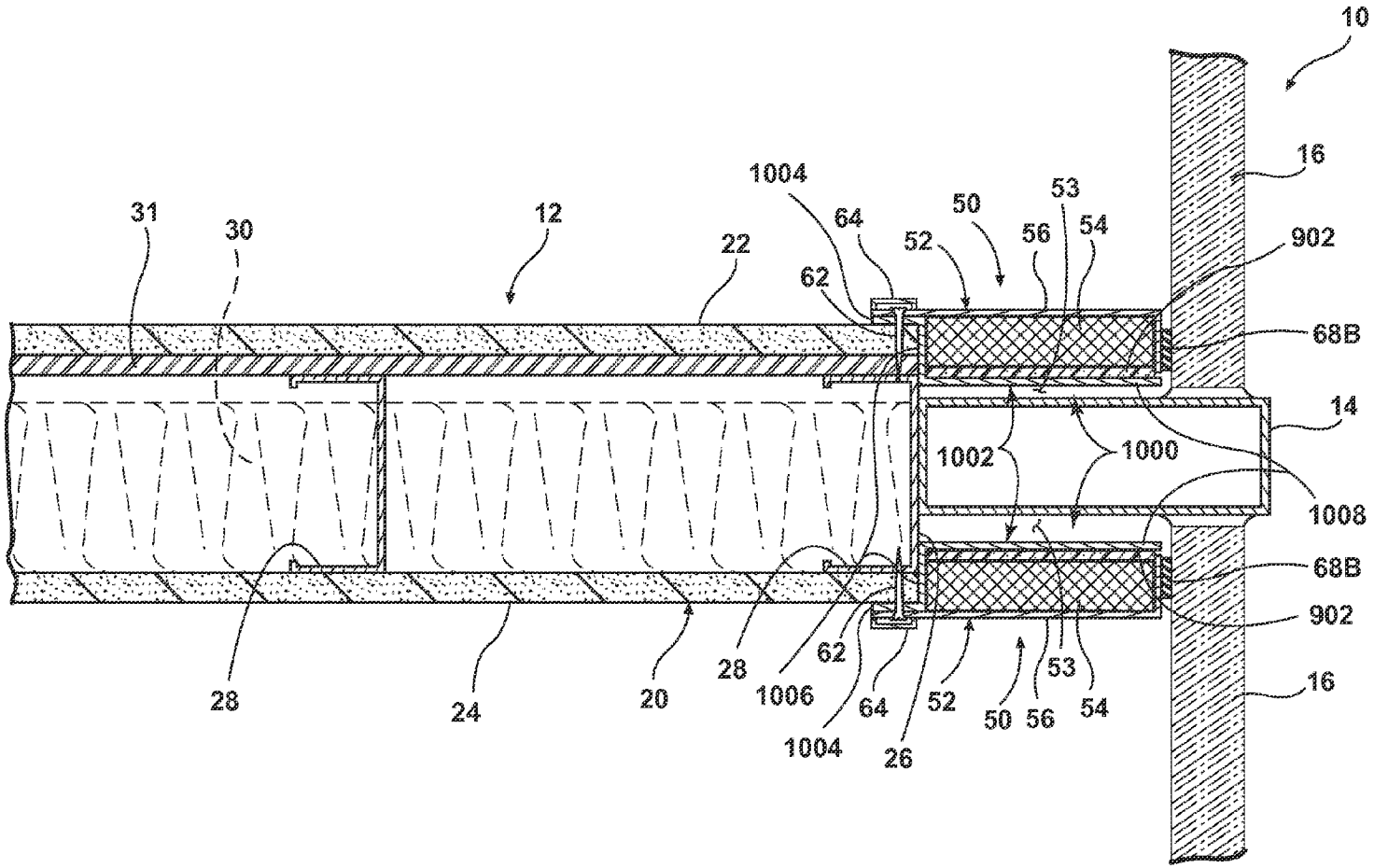

The fire rated expanding material 902 can include a first width 902*a* adjacent the second leg 1006 of the backing plate 1002 and a second width 902*b* adjacent the third leg 1008, as illustrated in FIG. 14A or a single width of material 902 adjacent the third leg 1008, as illustrated in FIG. 14B. The fire rated material 902 can be secured to the backing plate 1002 using any suitable mechanical or non-mechanical fastener, non-limiting examples of which include adhesives, welds, pins, tacks, clips, clamps, snaps and screws. While FIGS. 14A and 14B illustrate the fire rated material 902 abutting the sound insulating material 54, it is also within the scope of the invention for the fire rated material 902 to be spaced from the sound insulting material 54, such as by increasing the length of the second leg 1006 of the backing plate 1002.

Figure 15:
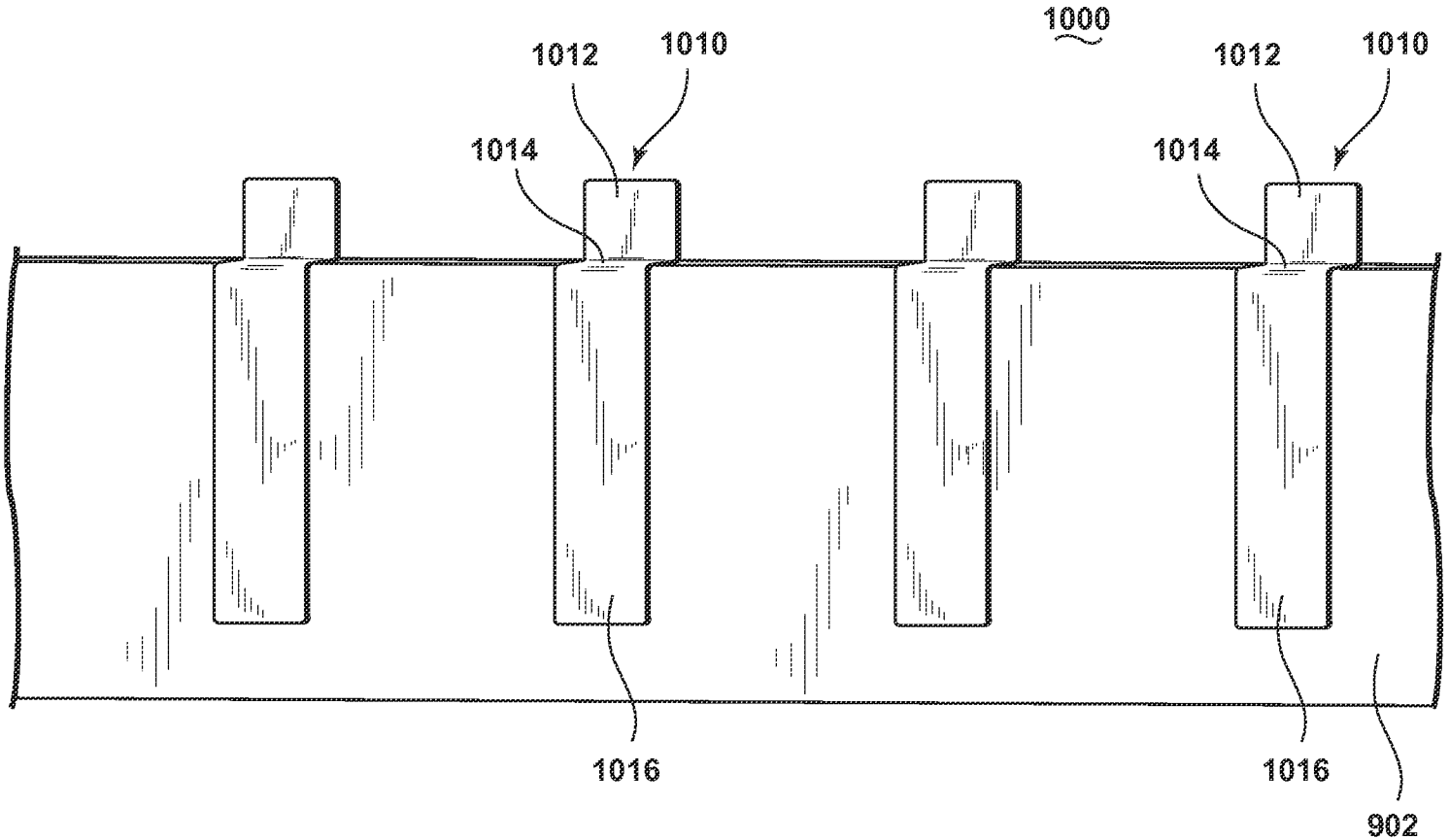
FIG. 15 is partial perspective view of a fire rated material and bracket according to an embodiment of the invention.

FIGS. 14A and 14B illustrate the backing plate 1002 as a continuous web or support plate extending substantially the height of the partition 20. In an alternative embodiment, illustrated in FIG. 15, the backing plate can be discontinuous in the form of a plurality of brackets 1010, which have the same cross section as the backing plate 1002, comprising a first leg 1012 for securing the bracket 1010 to the partition, a second leg 1014 and a third leg 1016 for mounting the fire rated material 902 in a manner similar to that described above for the backing plate 1002.

While the fire rated assemblies 900 and 1000 are described in the context of a fire rated material 902 in the form of an expanding fire rated material, it will be understood that the fire rated assemblies 900 and 1000 can be used with any other suitable type of fire rated material or combination of fire rated materials in a similar manner, non-limiting examples of which include firestopping insulation, such as a thermal ceramic insulation or fire batt insulation, fire rated mortar, fire rated caulk, fire rated gypsum material, vermiculite or perlite plaster products, and/or fire rated expanding foams or sealants.

While the fire rated assemblies 900 and 1000 are illustrated and described in the context of the wall cap 50, it will be understood that the fire rated assemblies 900 and 1000 can be used with any of the wall caps described herein in a similar manner. In addition, while the fire rated assemblies 900 and 1000 are illustrated as being used with a wall cap 50 including a compressible gasket 68B, it will be understood that fire rated assemblies 900 and 1000 can be used with or without a gasket. In addition, the fire rated assemblies 900 and 1000 can include additional fire rated materials in combination with the fire rated material 902 to provide the desired fire rating at the junction between the interior and exterior walls.

In addition, while the fire rated assemblies 900 and 1000 are described in the context of a wall cap 50 having sound insulating material 54 to provide vibration abating, it is also within the context of the invention for the fire rated assemblies 900 and 1000 to be used with a wall cap that does not include sound insulating material. Using the fire rated assemblies 900 and 1000 without the sound insulating material 54 can provide additional space for using thicker or bulkier fire rated materials, alternative fire rated materials or combinations of fire rated materials. For example, intumescent foam typically has a thinner profile than other materials, such as fire batt insulation, and thus requires less space. However, intumescent material can be more expensive than some other materials. Removing the sound insulating material 54 from the wall cap 50 provides more space within the wall cap 50 for using alternative materials that require more space than intumescent foams and/or combinations of materials to provide a desired fire rating.

Figure 16:
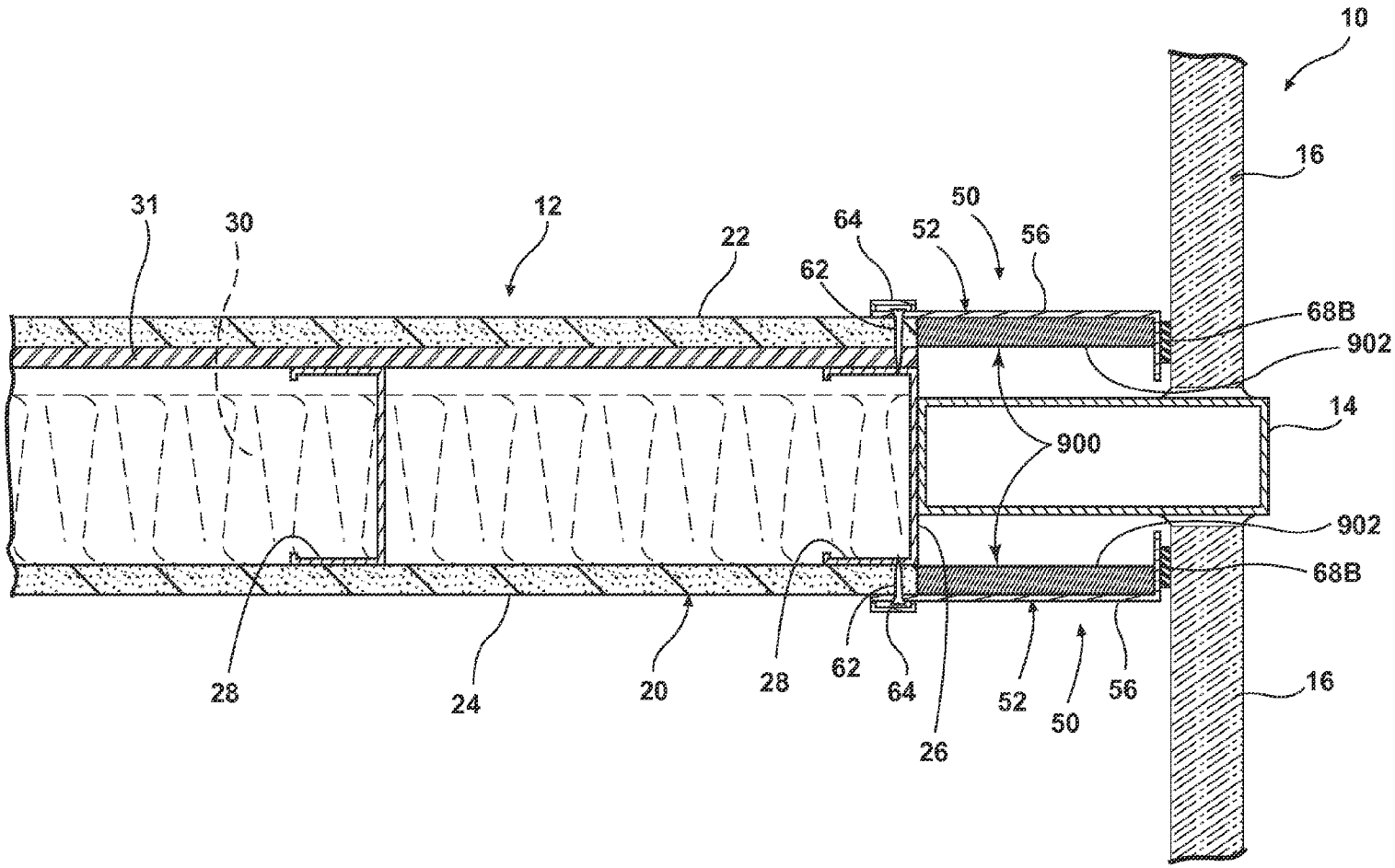
FIG. 16 is a partial cross-sectional view of a building structure and a wall cap having a fire rated assembly according to an embodiment of the invention.
Figure 17:
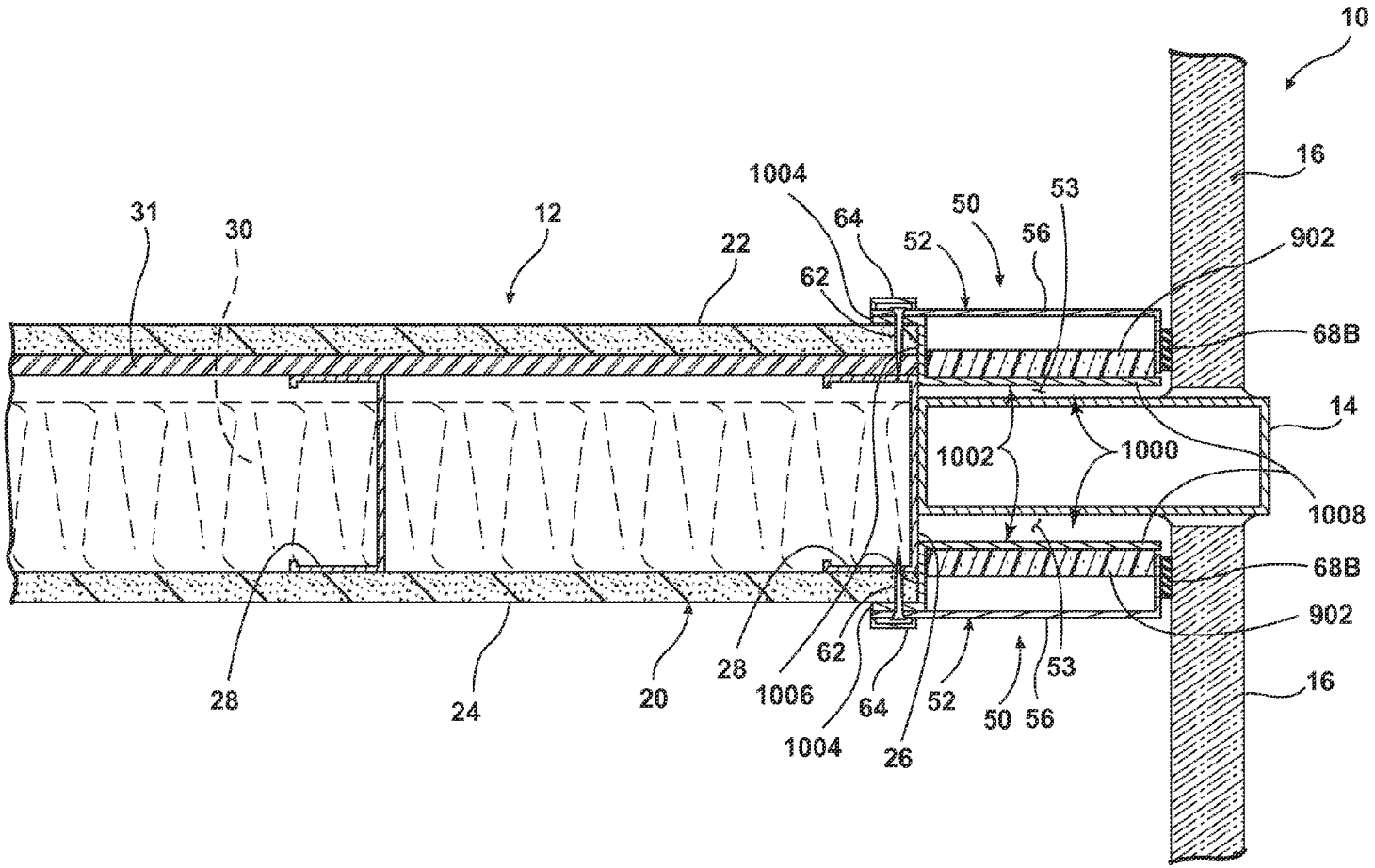
FIG. 17 is a partial cross-sectional view of a building structure and a wall cap having a fire rated assembly according to an embodiment of the invention.

For example, as illustrated in FIG. 16, the fire rated assembly 900 can be used with the wall cap 50, as illustrated in FIG. 13, without the sound insulating material 54 and with a thicker layer of fire rated material 902. The fire rated material 902 can be attached to the wall cap 50 using any suitable mechanical or non-mechanical fasteners, non-limiting examples of which include screws, clamps, clips, adhesives and welds. FIG. 17 illustrates another example in which the fire rated assembly 1000 is used with the wall cap 50, similar to that illustrated in FIG. 14B, except for the sound insulating material 54 has been removed, providing additional space to use a thicker layer of fire rated material 902 on the backing plate 1002.

It is also within the scope of the invention for the wall cap 50 and either of the fire rated assemblies 900 and 1000 to be provided with one or more materials that provide both vibration and fire abating properties. It will also be understood that depending on the materials used with the wall cap 50, the sound insulating material 54 can contribute to the fire abating properties of the wall cap 50 and the fire rated material 902 can contribute to the vibration abating properties without deviating from the scope of the invention.

In use, in the exemplary embodiment of a fire rated intumescent material, when the temperature of the material reaches a predetermined temperature, the intumescent foam can expand and at least partially fill the gap 53, thus abating the ability of fire, in the form of flame, heat and/or gas, to transfer through the gap 53 to the opposite side of the partition 20. In this manner, the intersection between the in-fill 16 and the partition 20 can be provided with a fire resistance rating corresponding to the fire resistance rating of the adjacent wall structure. Many building codes require that the gap at a curtain wall be treated so as to maintain the same fire integrity as the adjacent partition wall. When used with either the backing plate 1002 or brackets 1010, the backing plate 1002 and brackets 1010 provide support for the fire rated expanding material 902 before the material has expanded and also supports the resulting expanded material or char that forms during a fire event. Supporting the expanded material or char can contribute to providing the wall cap 50 with the desired fire rating.

The wall cap 50 can be used with any of the fire rated assemblies 900 or 1000 to provide a wall cap 50 that abates vibration and/or fire transmission properties of the gap 53 between an interior and exterior wall. The wall cap 50 in combination with the fire rated assembly 900 or 1000 can provide a first width of material that can absorb vibrations to abate both vibration transmission and amplification across the gap 53 between adjacent rooms. The fire rated material 902 provided by the fire rated assemblies 900 and 1000 can provide the wall cap 50 with a second width of material that abates fire transmission across the gap 53, thus providing fire integrity and protection at the junction between an interior wall (e.g. partition 20) and an exterior wall (e.g. in-fill 16) to stop or delay the spread of fire and/or transfer of heat between adjacent rooms. The wall cap 50 can also be used as described above to separately provide vibration abating without the use of the fire rated assemblies 900 and 1000 or to provide fire abating without the use of the sound insulating material 54.

The wall cap described herein provides an aesthetically appealing and durable system for abating vibration transmission and amplification and fire transmission through building partitions at the exterior perimeter or interior of a building having a curtain wall, window wall, ribbon window, or any wall system that utilizes a hollow tube framing system. The wall caps can be provided in a variety of colors and finishes to provide a desired aesthetic appearance. The wall caps can be assembled, packaged and shipped to the building site for installation and can easily be trimmed to the desired length and to fit around horizontal mullions, stepped sills or other obstructions on-site. The wall caps can be installed during building construction or retrofitted to existing structures and can be used with most curtain wall systems. In addition, when installed, the wall caps can be spaced from the mullion, thus allowing for differential movement between the building structure and the curtain wall system.

Because the wall cap cantilevers off of an adjacent partition and is not mounted to the mullion or the in-fill, the wall cap can be configured for use in a variety of different situations in which a partition terminates at a curtain wall, glass store front, window wall and/or interior glass partition, with or without a mullion. The wall cap can be used to abate vibration transmission and amplification and fire transmission between adjacent partitioned spaces regardless of whether the wall cap encompasses a mullion. This may be the case when a mullion system is not in use or when the partition terminates at a location not adjacent to a mullion. This provides the builder with added flexibility in designing and constructing spaces.

The wall cap also acts as a trim piece that conceals and trims the end of the partition which the wall cap cantilevers off of. For example, when the wall cap is used with a drywall partition, such as that shown in FIG. 2, the trim pieces 32 and 34 are not necessary. In this manner the wall cap provides both a functional benefit in that the transmission of sound through the mullion is decreased and an aesthetic benefit in that additional trim pieces are not needed.

The 2009 International Building Code requires demising walls of multi-family dwellings to have an STC rating of 50. The 2010 Guidelines for Design and Construction of Health Care Facilities has design criteria of a minimum STC rating of 45 between patient rooms and a minimum STC rating of 50 between intensive care rooms. As evidenced by the test data of Table 1, traditional curtain wall assemblies are unable to satisfy these requirements. The wall cap described herein provides an economical and easy to install system that is able to satisfy the 2009 International Building Code and the 2010 Guidelines for Design and Construction of Health Care Facilities requirements that can be installed during construction or retrofitted to existing structures. The insulation material provided with the wall caps can be selected based on the desired STC rating while taking budget concerns into consideration.

The wall cap further provided with the fire rated assemblies described herein can also provide a system to satisfy building codes for fire ratings. One example of such a building code is section 715 of the International Building Code, which includes requirements for mullions to provide the same fire resistance rating as required for the adjacent wall construction. The fire rated assemblies disclosed herein can be used in new construction as well as retro-fitted to existing structures to provide a fire rating to meet or exceed fire rating standards for building codes. In addition, the wall cap and fire rated assemblies can be used with various fire rated materials and combinations of fire rated materials to satisfy building codes that can vary depending on the location of the building structure and the agencies and groups which have jurisdiction over the fire requirements at that location. The wall cap and fire rated assemblies can further be updated or retrofitted to existing building structures as building codes and fire requirements change. For example, as new or improved materials for withstanding fire or providing a thermal barrier become available, these materials can be retrofitted to existing building structures to improve the fire rating or to maintain compliance with new regulations.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly disclosed.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A wall cap for an interior partition wall of a building structure, the building structure comprising at least one room having a first side defined at least partially by at least one exterior wall and a second side defined at least partially by at least one interior partition wall, and a gap formed between the at least one interior partition wall and the at least one exterior wall, the wall cap comprising:

at least one elongated member having a first end configured for attachment to the at least one interior partition wall and a second distal end in juxtaposition with the at least one exterior wall and being spaced from the at least one exterior wall, and having an outer surface extending substantially across the gap, an underside of the elongated member defining a chamber with at least a portion of the interior partition wall; and at least one material disposed within the chamber having at least one characteristic which abates at least one undesirable physical property of the gap;

wherein, when the at least one elongated member is mounted in cantilever fashion to a portion of the interior partition wall, such that the elongated member is allowed to move relative to the exterior wall, and substantially fills the gap between the interior partition wall and the corresponding exterior wall, the at least one material abates the at least one undesirable physical property of the gap.

2. The wall cap of claim 1 wherein the at least one material comprises at least one width of fire-rated material configured to abate the transmission of at least one of flame, heat or hot gases across the gap.

3. The wall cap of claim 2 wherein the at least one width of fire-rated material has a fire rating of at least 1 hour.

4. The wall cap of claim 2 wherein the at least one width of fire-rated material comprises a material that increases in volume when exposed to temperatures of about 300° F. and above.

5. The wall cap of claim 1 wherein the at least one material comprises at least one width of sound-damping material configured to abate at least one of transmission or amplification of vibration across the gap.

6. The wall cap of claim 5 wherein the sound-damping material comprises at least one of an open cell foam, a melamine-based foam, mass loaded vinyl, intumescent foam or combinations thereof.

7. The wall cap of claim 1 wherein the at least one material is adhesively secured to the underside of the elongated member, and the elongated member is mounted to the at least one interior partition wall by at least one fastener.

8. The wall cap of claim 1 wherein the at least one material comprises at least one first width of fire-rated material configured to abate the transmission of at least one of flame, heat or hot gases across the gap and at least one second width of sound-damping material configured to abate at least one of transmission or amplification of vibration across the gap.

9. The wall cap of claim 8 wherein the at least one first width of fire-rated material further comprises a backing plate having an offset flange mounted to the at least one interior partition wall.

10. The wall cap of claim 9 wherein the backing plate comprises a continuous web of material extending generally along a longitudinal length of the elongated member and receiving the first width of fire-rated material.

11. The wall cap of claim 9 wherein the backing plate comprises a plurality of brackets which retain the first width of fire-rated material to the at least one interior partition wall.

12. The wall cap of claim 9 wherein the second width of sound-damping material is mounted to the underside of the elongated member.

13. The wall cap of claim 12 wherein, when the elongated member is mounted to the at least one interior partition wall, the elongated member covers the at least one first width of fire-rated material, whereby the wall cap then provides both fire and vibration abating characteristics to the gap.

14. The wall cap of claim 1 wherein the second distal end of the elongated member comprises a distal outer surface in juxtaposition with the at least one exterior wall, and being spaced a distance from the at least one exterior wall, and further comprising at least one gasket disposed within the spaced distance between the distal outer surface of the elongated member and the at least one exterior wall, whereby the at least one gasket provides a seal between the elongated member and the at least one exterior wall.

15. The wall cap of claim 1 wherein the at least one characteristic of the at least one material abates a fire transmission property of the gap.

16. The wall cap of claim 1 wherein the at least one characteristic of the at least one material abates at least one of a vibration transmission or vibration amplification property of the gap.

17. A wall cap for an interior partition wall of a building structure, the building structure comprising at least one exterior wall having at least a portion formed from glass and at least one interior partition wall, and a gap formed between an end of the at least one interior partition wall and the glass portion of the exterior wall, the wall cap comprising:

at least one elongated member having a first end configured for attachment to the at least one interior partition wall and a second distal end in juxtaposition with the glass portion of the exterior wall and being spaced a distance from the glass portion of the exterior wall, and having an outer surface extending substantially across the gap, an underside of the elongated member defining a chamber with at least a portion of the interior partition wall; and wherein, the at least one elongated member is mounted in cantilever fashion to a portion of the interior partition wall, such that the elongated member is allowed to move relative to the glass portion of the exterior wall, and substantially fills the gap between the end of the interior partition wall and the corresponding glass portion of the exterior wall.

18. The wall cap of claim 17 and further including at least one material disposed within the chamber having at least one characteristic which abates at least one undesirable physical property of the gap.

19. The wall cap of claim 18 wherein the at least one material comprises at least one width of fire-rated material configured to abate the transmission of at least one of flame, heat or hot gases across the gap.

20. The wall cap of claim 18 wherein the at least one material comprises at least one width of sound-damping material configured to abate at least one of transmission or amplification of vibration across the gap.

21. The wall cap of claim 18 wherein the at least one material comprises at least one first width of fire-rated material configured to abate the transmission of at least one of flame, heat or hot gases across the gap and at least one second width of sound-damping material configured to abate at least one of transmission or amplification of vibration across the gap.

22. The wall cap of claim 17 wherein the second distal end of the elongated member comprises a distal outer surface in juxtaposition with the glass portion of the exterior wall, and being spaced a distance from the glass portion of the exterior wall, and further comprising at least one gasket disposed within the spaced distance between the distal outer surface of the elongated member and the glass portion of the exterior wall, whereby the at least one gasket provides a seal between the elongated member and the glass portion of the exterior wall.

23. A wall cap for an interior partition wall of a building structure, the building structure comprising at least one room defined by at least one exterior wall separating the room from an exterior of the building structure and at least one interior partition wall, and a gap formed between the at least one interior partition wall and the at least one exterior wall, the wall cap comprising:

at least one elongated member having a first end configured for attachment to the at least one interior partition wall and a second distal end in juxtaposition with the at least one exterior wall and being spaced from the at least one exterior wall, and having an outer surface extending substantially across the gap, an underside of the elongated member defining a chamber with at least a portion of the interior partition wall; and at least one material disposed within the chamber having at least one characteristic which abates at least one undesirable physical property of the gap;

wherein, when the at least one elongated member is mounted in cantilever fashion to a portion of the interior partition wall, such that the elongated member is allowed to move relative to the exterior wall, and substantially fills the gap between the interior partition wall and the corresponding exterior wall, the at least one material abates the at least one undesirable physical property of the gap.

24. The wall cap of claim 23 wherein the at least one material comprises at least one width of fire-rated material configured to abate the transmission of at least one of flame, heat or hot gases across the gap.

25. The wall cap of claim 24 wherein the at least one width of fire-rated material has a fire rating of at least 1 hour.

26. The wall cap of claim 24 wherein the at least one width of fire-rated material comprises a material that increases in volume when exposed to temperatures of about 300° F. and above.

27. The wall cap of claim 23 wherein the at least one material comprises at least one width of sound-damping material configured to abate at least one of transmission or amplification of vibration across the gap.

28. The wall cap of claim 27 wherein the sound-damping material comprises at least one of an open cell foam, a melamine-based foam, mass loaded vinyl, intumescent foam or combinations thereof.

29. The wall cap of claim 23 wherein the at least one material is adhesively secured to the underside of the elongated member, and the elongated member is mounted to the at least one interior partition wall by at least one fastener.

30. The wall cap of claim 23 wherein the at least one material comprises at least one first width of fire-rated material configured to abate the transmission of at least one of flame, heat or hot gases across the gap and at least one second width of sound-damping material configured to abate at least one of transmission or amplification of vibration across the gap.

31. The wall cap of claim 30 wherein the at least one first width of fire-rated material further comprises a backing plate having an offset flange mounted to the at least one interior partition wall.

32. The wall cap of claim 31 wherein the backing plate comprises a continuous web of material extending generally along a longitudinal length of the elongated member and receiving the first width of fire-rated material.

33. The wall cap of claim 31 wherein the backing plate comprises a plurality of brackets which retain the first width of fire-rated material to the at least one interior partition wall.

34. The wall cap of claim 31 wherein the second width of sound-damping material is mounted to the underside of the elongated member.

35. The wall cap of claim 34 wherein, when the elongated member is mounted to the at least one interior partition wall, the elongated member covers the at least one first width of fire-rated material, whereby the wall cap then provides both fire and vibration abating characteristics to the gap.

36. The wall cap of claim 23 wherein the second distal end of the elongated member comprises a distal outer surface in juxtaposition with the at least one exterior wall, and being spaced a distance from the at least one exterior wall, and further comprising at least one gasket disposed within the spaced distance between the distal outer surface of the elongated member and the at least one exterior wall, whereby the at least one gasket provides a seal between the elongated member and the at least one exterior wall.

37. The wall cap of claim 23 wherein the at least one characteristic of the at least one material abates a fire transmission property of the gap.

38. The wall cap of claim 23 wherein the at least one characteristic of the at least one material abates at least one of a vibration transmission or vibration amplification property of the gap.

* * * * *